US006532874B2

(12) United States Patent
Yoon

(10) Patent No.: US 6,532,874 B2
(45) Date of Patent: Mar. 18, 2003

(54) METHOD OF BLASTING BENCH OF ROCK WITH IMPROVED BLASTING EFFICIENCY AND REDUCED BLASTING NUISANCE

(75) Inventor: Young-Jae Yoon, Seoul (KR)

(73) Assignee: T & RB Co., Ltc. (KR)

( * ) Notice: Subject to any disclaimer, the term of this patent is extended or adjusted under 35 U.S.C. 154(b) by 0 days.

(21) Appl. No.: 10/034,348

(22) Filed: Dec. 28, 2001

(65) Prior Publication Data

US 2003/0019383 A1 Jan. 30, 2003

(30) Foreign Application Priority Data

Mar. 20, 2001 (KR) ..... 2001-14411

(51) Int. Cl.[7] ..... F42B 3/00
(52) U.S. Cl. ..... 102/311
(58) Field of Search ..... 102/302, 311, 102/312, 313; 175/4.55

(56) References Cited

U.S. PATENT DOCUMENTS 3,648,614 A * 3/1972 Berthmann et al. ..... 102/313
3,903,799 A * 9/1975 Walker ..... 102/311
4,353,598 A * 10/1982 Ricketts ..... 102/312 X
4,513,665 A * 4/1985 Ricketts et al. ..... 102/313 X
4,960,171 A * 10/1990 Parrott et al. ..... 175/4.55 X
5,090,325 A * 2/1992 Saito et al. ..... 102/313 X
5,388,521 A * 2/1995 Coursen ..... 102/311
5,634,691 A * 6/1997 Kim et al. ..... 102/312 X
6,014,933 A * 1/2000 Umphries et al. ..... 102/313 X
6,431,075 B2 * 8/2002 Shim ..... 102/313 X
6,454,359 B1 * 9/2002 Kang ..... 102/313 X
6,460,462 B1 * 10/2002 Rosenstock ..... 102/313 X

* cited by examiner

*Primary Examiner*—Peter A. Nelson
(74) *Attorney, Agent, or Firm*—Harness, Dickey & Pierce, P.L.C.

(57) ABSTRACT

The present invention relates to a blasting method of rock, by which blasting nuisances can be reduced and blasting efficiency increased. The method utilizes a blasting mechanism comprising the steps of: successively drilling a plurality of blasting holes on a upper free surface of a bench of rock with two free surface consisting of the upper free surface and a slant free surface extended from the upper free surface or on a free surface of rock with one free surface, in which the blasting holes are arranged in straight line and consist of a first group of first-order blasting holes, a second-order blasting hole and a second group of first-order blasting holes; charging the blast holes with an explosive; blasting the first-order blasting holes so as to form four free surfaces around the second-order blasting hole; and blasting the second-order blasting holes in a state where the four free surfaces were formed. The blasting mechanism can be applied to control the size of fractured rock, or to make even a surface of blasted rock floor, or to conduct blasting processes coincided with field conditions. In addition, the blasting mechanism of the present invention can be applied in blasting for the excavation of rock with one free surface, and also in presplitting blasting of rock for formation of a slope on rock.

16 Claims, 25 Drawing Sheets

METHOD OF BLASTING BENCH OF ROCK WITH IMPROVED BLASTING EFFICIENCY AND REDUCED BLASTING NUISANCE

BACKGROUND OF THE INVENTION

The present invention relates to a low vibration blasting method of bench rock with two free surfaces and a general blasting method of bench rock with two free surfaces. As used herein, the term "low vibration blasting method of a bench" means a blasting method of a bench of rock, which is conducted at reduced charge amounts per delay after holes are drilled with leg drills of a small bore (i.e., about 38 mm diameter) so as to have a relatively short drilling length and a relatively narrow drilling interval. The term "general blasting method of a bench" means a large-scale blasting method of a bench of rock, which is conducted with a large amount of explosives after holes are drilled with crawler drills of a large bore (1.e., about 45 mm to 75 mm diameter) so as to have a relatively long drilling length and a relatively drilling interval.

FIG. 1*a* is a plane view showing a general structure of a bench of rock with two free surfaces, and FIG. 1*b* is a cross-sectional view taken along the line A–A' in FIG. 1*a*. As shown in FIGS. 1*a* and 1*b*, the bench of rock has two free surfaces, an upper free surface 1 and a slant free surface 2 extended slantly from the upper surface 1. In addition, the bench of rock has a given width 3, a given length 4 and a given height 5.

Conventionally, multiple blasting holes are drilled along a surface of a bench having two free surfaces, at regular intervals, generally at intervals corresponding to 1.2 times as large as a burden, and then charged with explosives. Thereafter, one blasting hole positioned at a central portion of the bench is blasted first so as to form a third free surface, and then blasting holes arranged at the left and right sides of the central hole are blasted. Such a blasting mechanism is applied for the low vibration blasting of bench and the general blasting of bench, in the same manner. In this case, although blasting vibration and blasting noise can be reduced by changing the charge amounts per delay depending on the drilling interval and depth, the control of the charge amounts per delay under the same conditions has limitations.

In order to reduce blasting nuisances, such as blasting vibration, blasting noise, air overpressure, fly rock and the like, a blasting mechanism is required, by which optimal blasting is carried out at minimized charge amounts per delay, and the number of free surfaces is increased by regulation of the blasting sequence.

Blasting methods of bench of two free surfaces, which are widely employed nowadays, can be classified according to drilling form into a downward drilling type and a horizontal drilling type. Also, according to application, they can be classified into a general blasting method of bench carried out at an area having no connection with blasting nuisance, and a low vibration blasting method of bench conducted in the vicinity of a sensitive structure or a stall for reduction of blasting nuisance.

The blasting method of the vertical drilling type is a method that is mainly used for blasting an open-air bench with two free surfaces. In this method, as the main drilling direction is vertical or slanted downward from ground, large-scale blasting operations can be carried out by employing equipment to the maximum level. Thus, this method is applied for blasting of bench in a quarry or a working area for large-scale cutting, etc. On the other hand, the blasting method of the horizontal drilling type is mainly applied for blasting of benches in underground caves or tunnels at which holes must be horizontally drilled in view of working conditions. Thus, it is inferior to the vertical drilling type in productivity so is not particularly used except in special cases.

FIG. 2*a* is a plane view showing a downward drilling pattern according to the prior general blasting method of bench, and FIG. 2*b* is a cross-sectional view taken along the line A–A' of FIG. 2*a*. As shown in FIGS. 2*a* and 2*b*, plural blasting holes 6 are formed downward on the upper free surface 1 of the bench in a direction parallel to the vertical or slant free surface 2, charged with explosives and then blasted. The method illustrated in FIGS. 2*a* and 2*b* has high productivity as it makes large-scale blasting possible. Thus, it is mainly used in a large-scale quarry or a working area for large-scale cutting. In addition, in order to make the upper free surface even, sub-holes 8 may also be drilled and blasted. However, it requires additional drillings and charges and thus is used only for special cases.

FIG. 3*a* is a plane view showing a horizontal drilling pattern according to the prior general blasting method of bench, and FIG. 3*b* is a cross-sectional view taken along the line A–A' of FIG. 3*a*. As shown in FIGS. 3*a* and 3*b*, blasting holes 9 are drilled at the vertical or slant free surface 2 of the bench in a direction parallel to the upper free surface 1, charged with explosives and then blasted. The method shown in FIGS. 3*a* and 3*b* is mainly used for blasting of benches in tunnels or underground caves.

Furthermore, the low vibration blasting method of bench according to the prior art utilizes the same blasting concept as that of the general blasting method of bench. In this low vibration blasting method, however, in order to reduce blasting nuisance, blast holes are drilled so as to have a short drilling interval and length, and are blasted with a small amount of explosives. According to this low vibration blasting method of bench, blasting nuisance can be limited. However, this method is disadvantageous in that blasting costs are expensive.

In the blasting method of bench according to the prior art, the downward holes 6 or the horizontal holes 9 are collectively drilled at the upper free surface 1 or the slant free surface 2 in one side direction. Then, as shown in FIG. 4, rod-like charge or deck charge is carried out. In this charge process, a primer cartridge 35 is placed in an indirect priming manner, a middle priming manner or a direct priming manner. Then, the bench is blasted on two free surfaces so that only the blasting effect forms a third free surface in a blasting process. As used herein, the term "indirect priming manner" means that primer cartridge 35 is placed at the bottom portion of the hole, and an explosive 36 is placed above the primer cartridge 35, as in the left hole 32 in FIG. 5. The term "middle priming manner" means that the primer cartridge 35 is placed at a middle portion of the hole, and an explosive is placed at the upper and lower portions of the primer cartridge 35, as in the middle hole 33 in FIG. 5. The term "direct priming manner" means that the primer cartridge 35 is placed at the entrance to the hole, and an explosive is placed below the primer cartridge 35, as in the right hole 34 in FIG. 5. Also, in FIG. 5, the reference numeral 38 denotes a tamping.

Blasting of a bench with two free surfaces is mostly carried out in an open air area, and may have an influence on the surrounding area, such as private houses, buildings, stalls and fishing places, etc. For this reason, it requires special attention.

Examples of blasting nuisances occurring upon blasting in an open air area include blasting vibration, blasting noise, air overpressure, fly rock and the like. The reason for the blasting nuisance is because significant portions of the explosive are lost into the vibration, noise, heat and light, etc., upon detonation of the explosive in the drilled rock, by a powerful chemical reaction in which great energy is released in a short time. For this reason, the surrounding rock or structure may be damaged due to the blasting nuisances.

Therefore, in order to solve the above-mentioned problem caused by blasting nuisance, the number of cracks and free surfaces need to be increased as much as possible such that much explosive energy of the explosives may be applied in fracturing rock, whereby optimal blasting can be performed.

SUMMARY OF THE INVENTION

Accordingly, the present invention has been made to solve the above-mentioned problems occurring in the prior art, and an object of the present invention is to provide a blasting method of a bench of rock, by which blasting nuisance can be reduced and blasting efficiency increased.

It is other object of the present invention to provide a blasting method of a bench of rock, by which the size of fractured rock can be controlled while blasting nuisance can be reduced and blasting efficiency increased.

It is another object of the present invention to provide a blasting method of a bench of rock, by which a bottom surface of blasted base rock can be level and at the same time, reducing blasting nuisance and increasing blasting efficiency.

It is also another object of the present invention to provide a blasting method of a bench of rock, which can be conducted so as to coincide with field conditions, and by which blasting nuisance can be reduced and blasting efficiency increased.

It is still another object of the present invention to provide a blasting method for the excavation of rock, by which initial blasting of a first free surface can be achieved, and at the same time, reducing blasting nuisance and increasing blasting efficiency.

It is yet another object of the present invention to provide a blasting method of a bench of rock, by which a slope can be formed, and at the same time, reducing blasting nuisance and increasing blasting efficiency.

To accomplish this object, there is provided a blasting method of rock, which utilizes a blasting mechanism comprising the steps of: successively drilling a plurality of blasting holes on a upper free surface of a bench of rock with two free surface consisting of the upper free surface and a slant free surface extended from the upper free surface or on a free surface of rock with one free surface, in which the blasting holes are arranged in a straight line and consist of a first group of first-order blasting holes, a second-order blasting hole and a second group of first-order blasting holes; charging the blasting holes with an explosive; blasting the first-order blasting holes so as to form four free surfaces around the second-order blasting hole; and blasting the second-order blasting hole in a state where the four free surfaces were formed. In the blasting mechanism according to the present invention, the first-order blasting holes consist of either two presplitting holes, or two presplitting holes and one delay blasting hole placed between the presplitting holes, or presplitting holes and/or delay blasting holes of any number or drilling pattern, that can be blasted with small amount of explosives and low vibration and allows formation of four free surfaces around the second-order blasting hole.

According to the blasting method of the present invention, after the first-order blasting process is conducted using a reduced charge amount per delay, the second-order blasting process is carried out in a state where four free surfaces were formed as a result of the first-order blasting. Therefore, in the blasting method of the present invention, blasting efficiency can be increased, and blasting nuisances, such as blasting vibration and blasting noise, etc., can be significantly reduced.

BRIEF DESCRIPTION OF THE DRAWINGS

The above and other objects, features and advantages of the present invention will be more apparent from the following detailed description taken in conjunction with the accompanying drawings, in which.

Figure 17A:
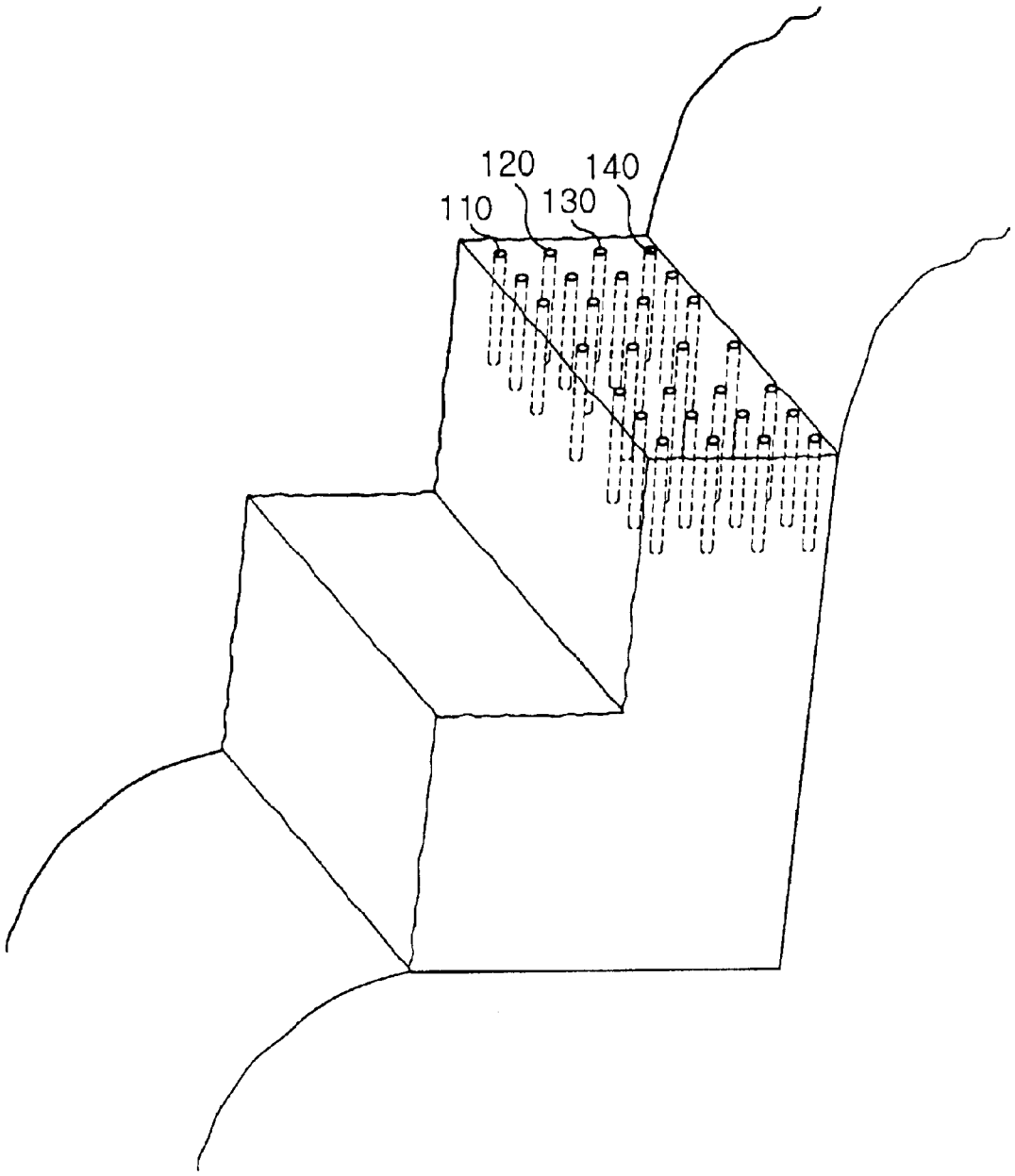
FIG. 17*a* is a perspective view of a bench of rock, which shows the blasting mechanism of the present invention applied to a presplitting blasting method for formation of a slope.
Figure 17B:
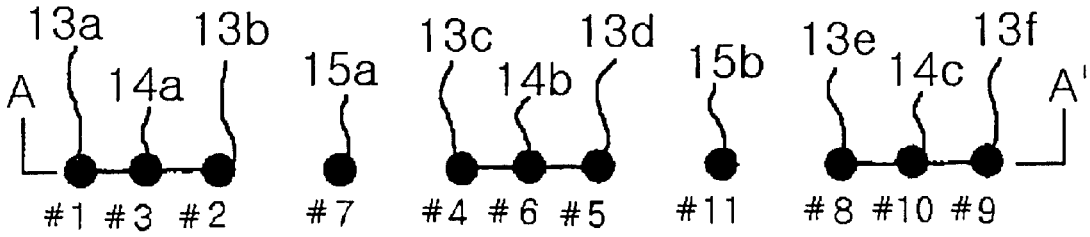
FIG. 17*b* is a plane view showing each of rows of blasting holes formed on the bench of FIG. 17*a;*

17*c* is a cross-sectional view taken along the line A–A' in FIG. 17*b;*

Figure 18A:
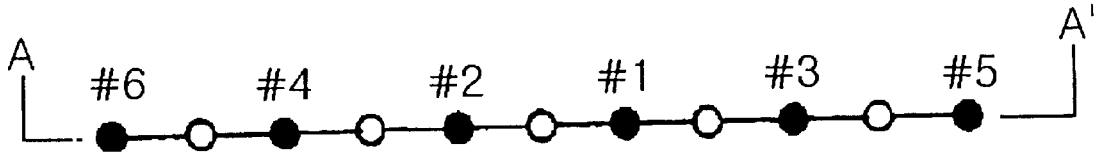
FIG.18a (PRIOR ART)
Figure 18B:
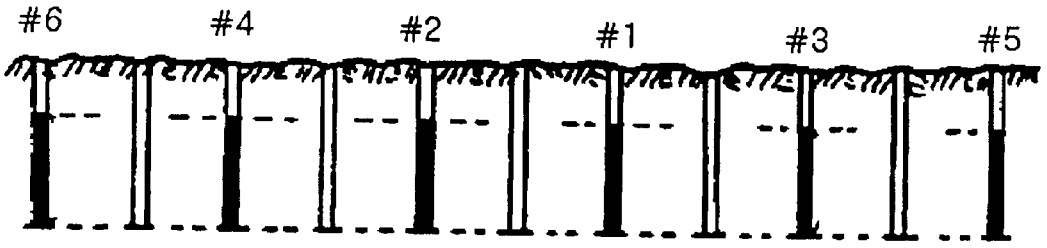
FIG.18b (PRIOR ART)

FIG. 18*a* is a plane view showing a presplitting blasting method of a bench of rock according to the prior art;

FIG. 18*b* is a cross-sectional view taken along the line A–A' in FIG. 18*a;*

Figure 19A:
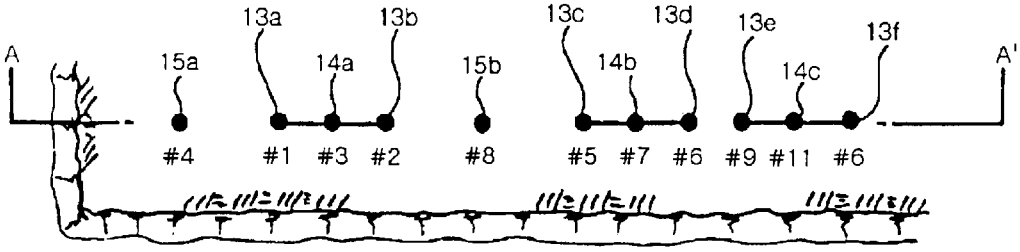
Figure 19B:
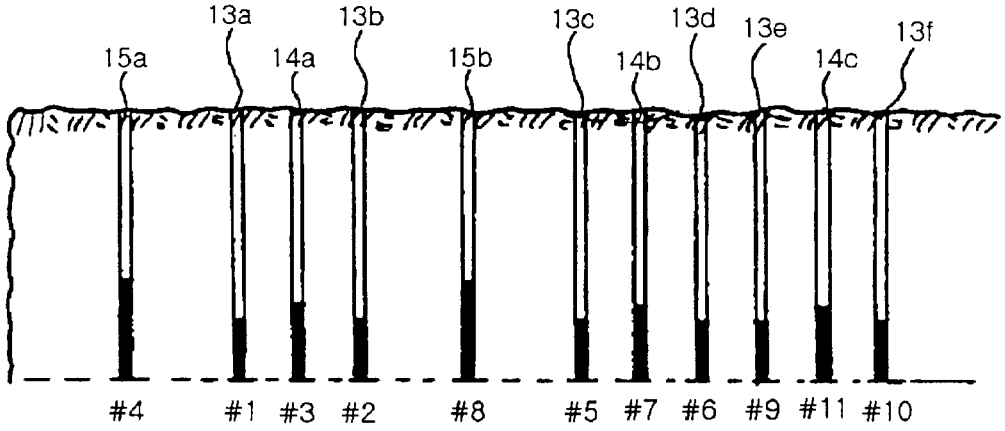

FIG. 19*a* is a plane view which indicates that the blasting mechanism of the present invention is applied in the blasting of a bench of rock where the last portion of a drilling pattern are remarkably short;

FIG. 19*b* is a cross-sectional view taken along the line A–A' in FIG. 19*a;*

Figure 20A:
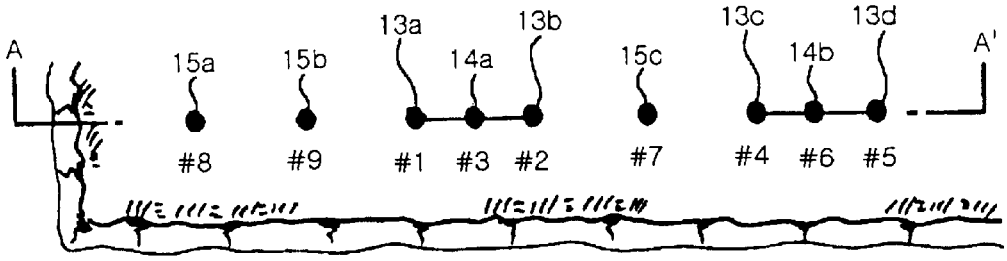
Figure 20B:
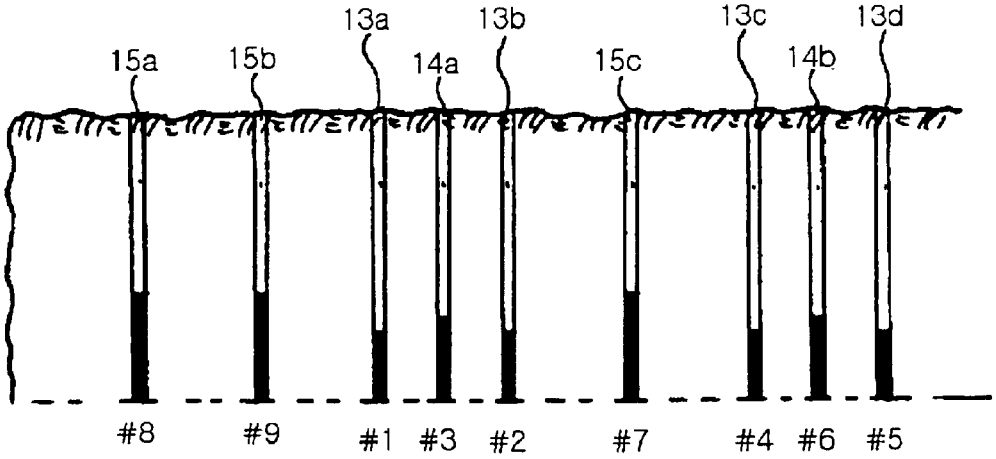

FIG. 20*a* is a plane view which indicates that the blasting mechanism of the present invention is applied in the blasting of a bench of rock where the last portion of a drilling pattern are remarkably short;

FIG. 20*b* is a cross-sectional view taken along the line A–A' in FIG. 20*a;*

Figure 21A:
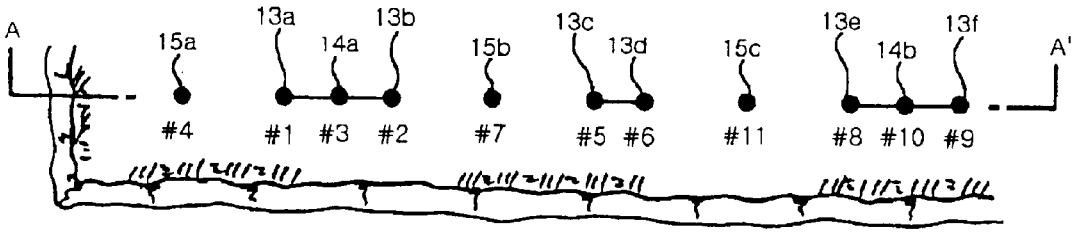
Figure 21B:
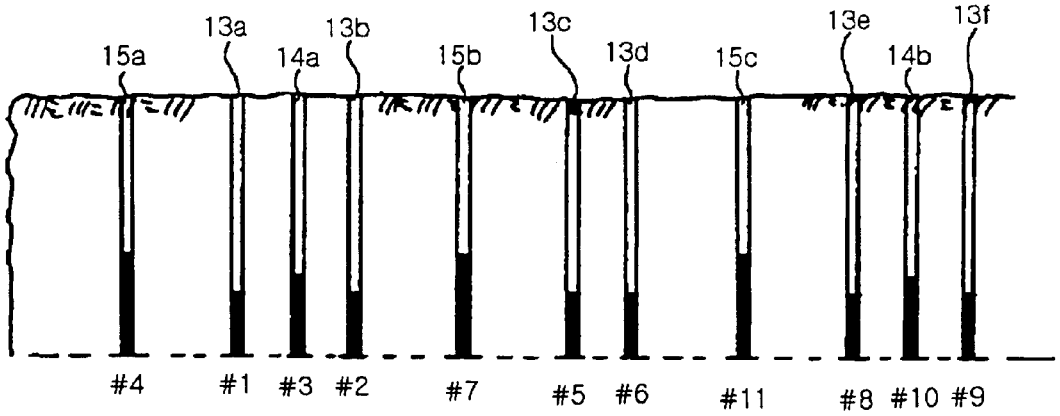

FIG. 21*a* is a plane view which indicates that the blasting mechanism of the present invention is applied in the blasting of a bench of rock where the last portion of a drilling pattern are remarkably short;

FIG. 21*b* is a cross-sectional view taken along the line A–A' in FIG. 21*a;*

Figure 22A:
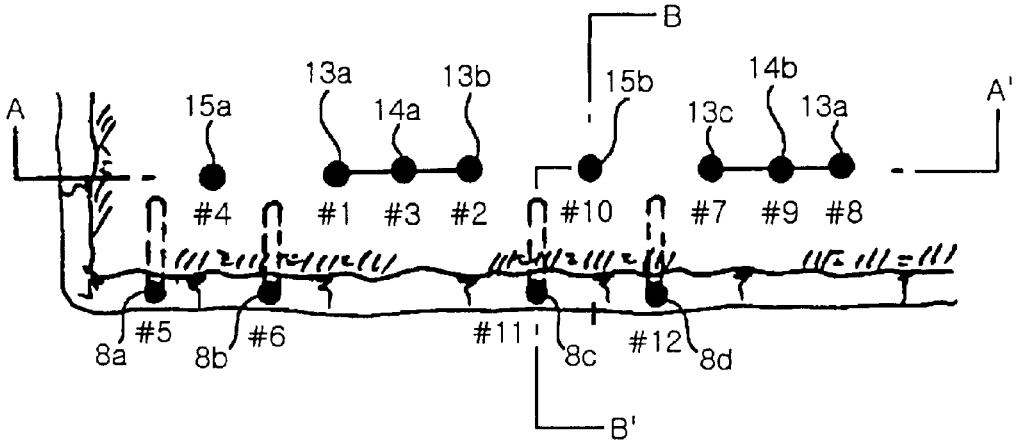
Figure 22B:
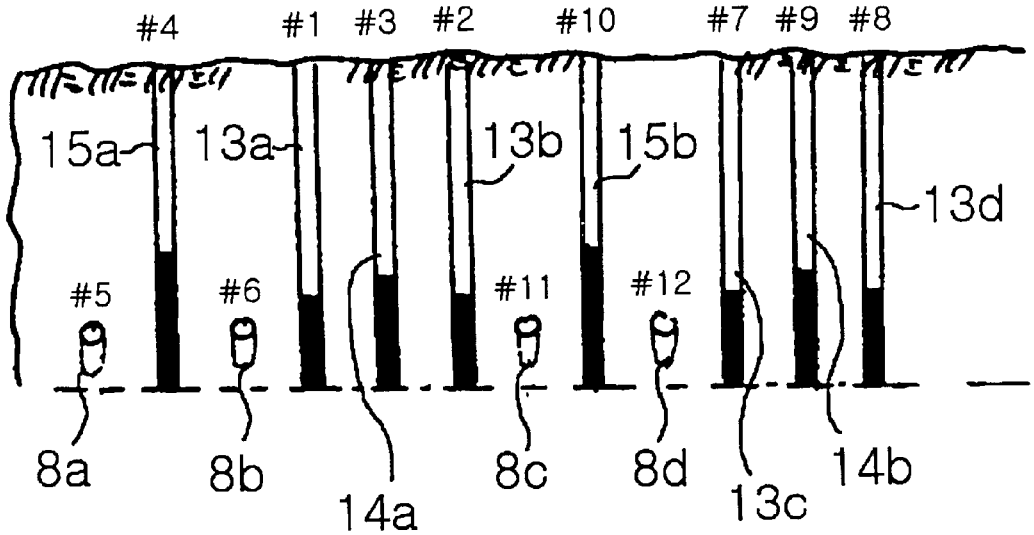

FIG. 22*a* is a plane view which indicates that the blasting mechanism of the present invention is applied for regulation of a surface of blasted rock;

FIG. 22*b* is a cross-sectional view taken along the line A–A' in FIG. 22*a;*

Figure 22C:
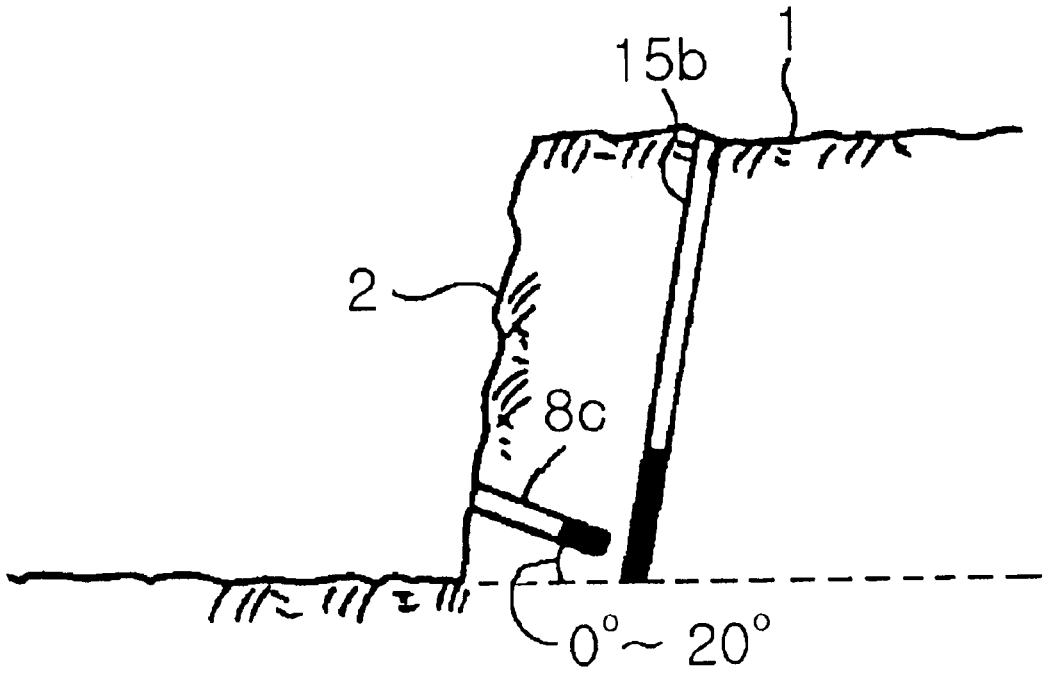

FIG. 22*c* is a cross-sectional view taken along the line B–B' in FIG. 22*a;*

Figure 23A:
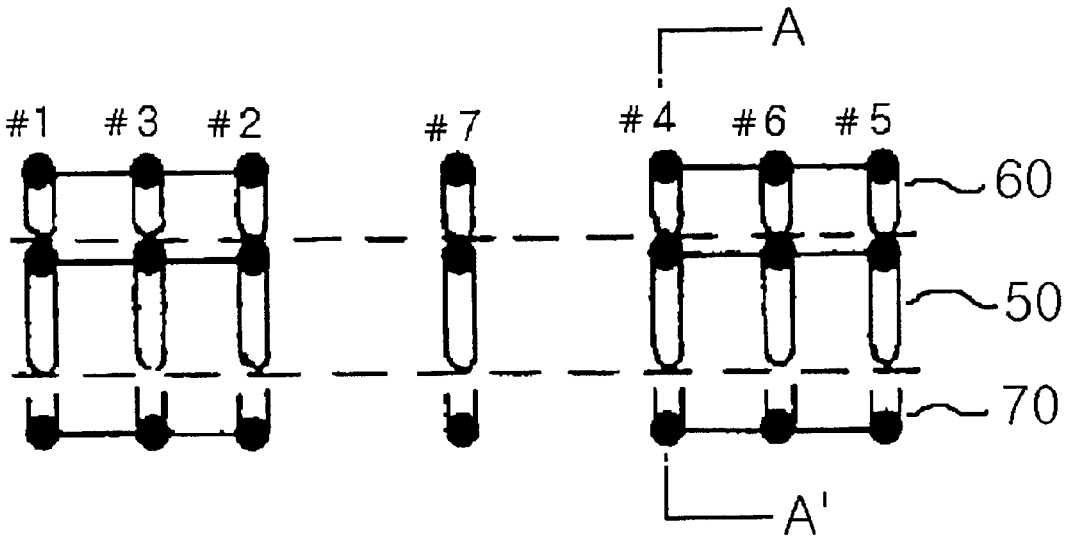
Figure 23B:
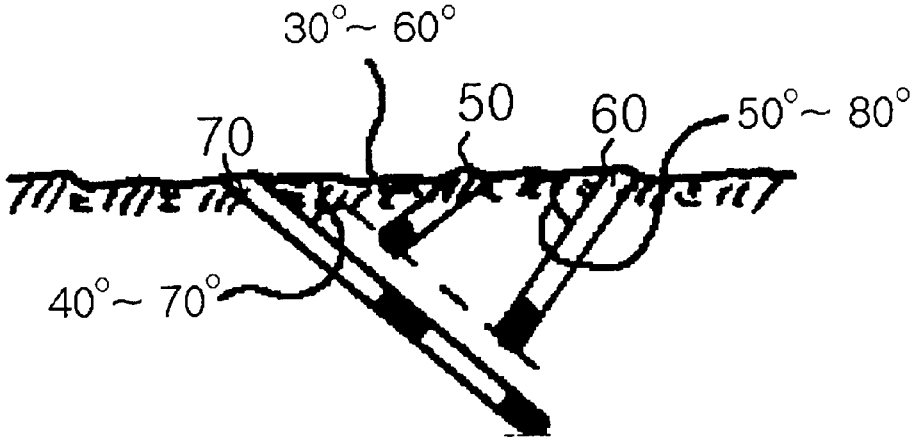

FIG. 23*a* is a plane view showing that the blasting mechanism of the present invention is applied in the blasting for the excavation of rock with one free surface;

FIG. 23*b* is a cross-sectional view taken along the line A–A' in FIG. 23*a;*

Figure 24A:
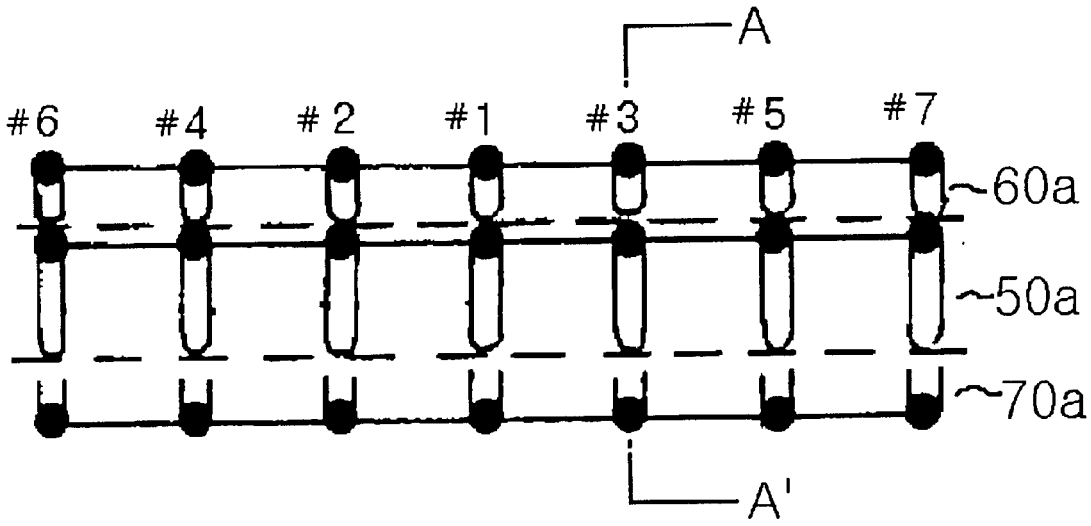
FIG.24a (PRIOR ART)
Figure 24B:
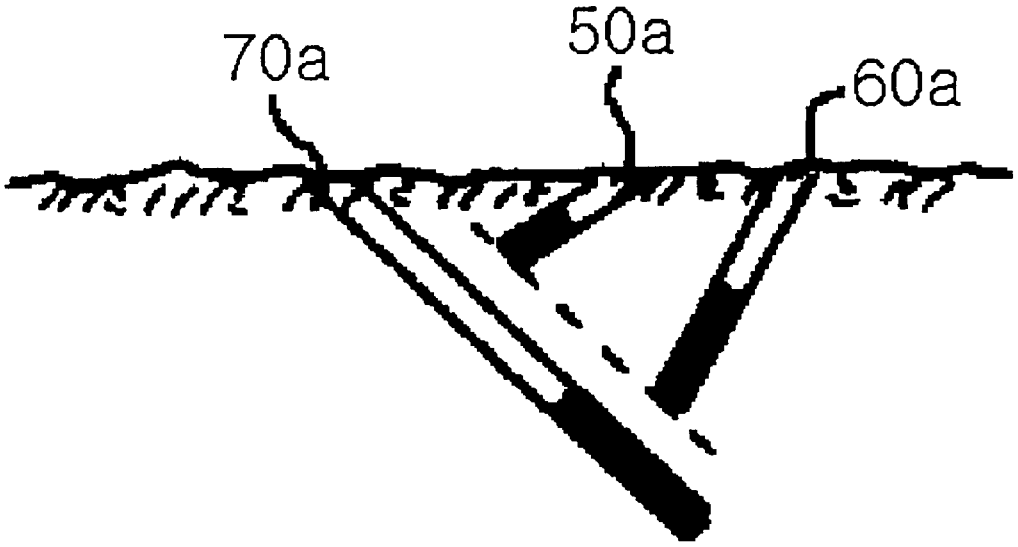
FIG.24b (PRIOR ART)

FIG. 24*a* is a plane view showing a blasting method for the excavation of rock according to the prior art; and FIG. 24*b* is a cross-sectional view taken along the line A–A' in FIG. 24*a.*

DETAILED DESCRIPTION OF THE PREFERRED EMBODIMENTS

Hereinafter, a preferred embodiment of the present invention will be described with reference to the accompanying drawings. In the following description and drawings, the same reference numerals are used to designate the same or similar components, and so repetition of the description on the same or similar components will be omitted.

Embodiment 1

Figure 6A:
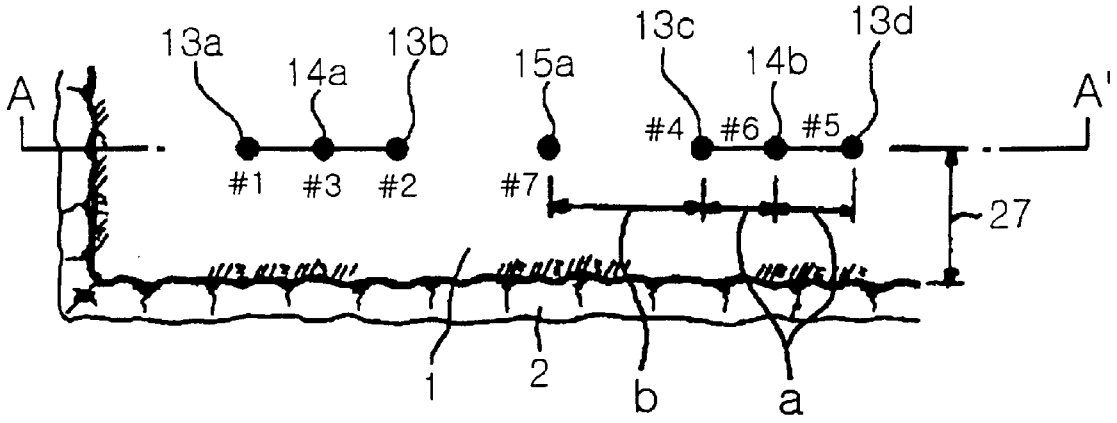
FIG. 6*a* is a plane view of a bench of rock, which indicates that the blasting mechanism according to the present invention is applied for the blasting of a bench of rock with an average width and length.
Figure 6B:
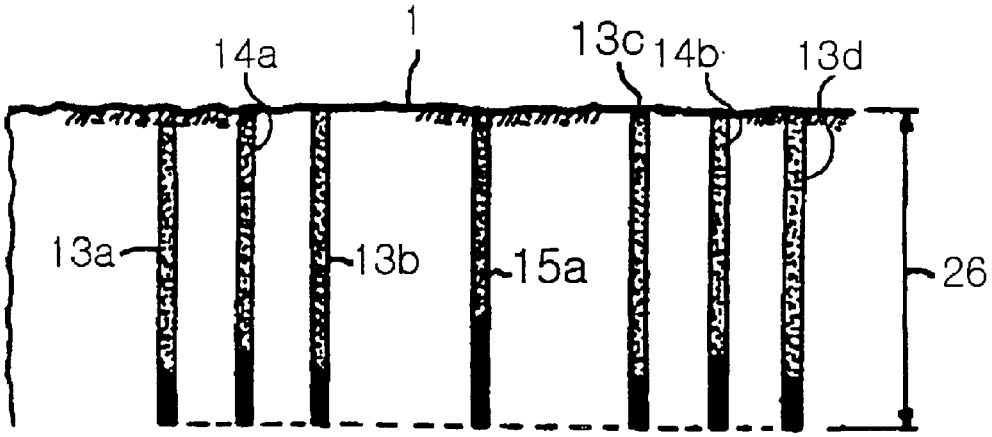
FIG. 6*b* is a cross-sectional view taken along the line A–A' in FIG. 6*a;*

FIG. 6*a* is a plane view of a bench of rock, which shows the blasting mechanism according to the present invention applied for blasting a bench of rock with an average width and length, and FIG. 6*b* is a cross-sectional view taken along the line A–A' in FIG. 6*a*. As shown in FIGS. 6*a* and 6*b*, a first group of first-order blasting holes consisting of three adjacent holes 13*a*, 14*a* and 13*b* are drilled downward on a upper free surface 1 of a bench with the upper free surface 1 and a slant free surface 2. A second group of first-order blasting holes consisting of three adjacent holes 13*c*, 14*b* and 13*d* are drilled downward. Also, a second-order blasting hole 15*a* is drilled downward on the upper free surface in such a manner that it is placed between the first and second groups of first-order blasting holes. In this way, a drilling pattern is formed. As used herein, the term "second-order blasting hole" has the same meaning as an enlarged hole and thus is used interchangeably with "enlarged hole".

The second-order blasting hole 15*a* has a large drilling diameter since it is blasted on four free surfaces. In this embodiment, the first group of first-order blasting holes consists of two presplitting holes 13*a* and 13*b* and one delay blasting hole 14*a* placed between the presplitting holes 13*a* and 13*b*. The second group of first-order blasting holes consists of two presplitting holes 13*c* and 13*d* and one delay blasting hole 14*b* placed between the presplitting holes 13*c* and 13*d*. Moreover, these blasting holes are arranged in a straight line on the upper free surface 1.

In the above-mentioned drilling process, a drilling length 26 is determined depending on the charge amount per delay determined within an allowable blasting vibration limit. In order to reduce a charge amount per delay, an interval between the presplitting holes and the delay-blasting hole in the respective first-order blasting holes is such that the presplitting holes are positioned within the range of a crushing zone to a fracture zone with respect to the delay blasting hole. Such an interval between the presplitting holes and the delay-blasting hole is about 0.6 times to 0.8 times as large as a burden 27. An interval between the second-order blasting hole 15 and the presplitting holes adjacent thereto is about 1.5 times to about 2 times as large as a burden 27.

The blasting holes consisting of the presplitting holes, the delay blasting holes and the second-order blasting hole, are drilled at an angle parallel to the vertical or slant free surface 2. The drilling angle of the blasting holes with respect to the upper free surface is principally 90 degrees, but in some cases ranges from 70 degrees to 90 degrees. In this regard, the reason for this chosen angle is because, if the drilling angle is less than 70 degrees, a fractured amount of blasted rock is reduced as the drilling angle is decreased, and much fly rock is generated, whereby the blasting process is uneconomical. Another reason is that it is difficult to conduct angular drilling due to the structure of the drilling equipment (crawler drill).

After drilling, the blasting holes are charged with explosives. In this embodiment, in order to reduce a charge amount per delay, a charge corresponding to that of one blasting hole according to the prior art is divided and charged into three first-order blasting holes according to the present invention.

A charge amount for the presplitting holes of the respective groups of the first-order blasting holes is in the range of about 40% to 60% by weight relative to the standard charge amount according to the prior art, and a charge amount for the delay blasting hole is in the range of about 50% to 70% by weight relative to the standard charge amount. Also, a charge amount for the second-order blasting hole 15 ranges from about 80% to 100% by weight. In other words, the presplitting holes and the delay blasting hole are charged at a specific charge amount of about 0.1 $kg/m^3$ to about 0.25 $kg/m^3$, respectively, and the second blasting hole is charged at a specific charge amount of about 0.2 $kg/M^3$ to about 0.3 $kg/m^3$. A specific charge amount according to the prior art is in the range of 0.2 $kg/m^3$ to 0.35 $kg/m^3$ depending on the strength of the rock to be blasted.

The presplitting holes and the delay blasting hole which constitute the first-order blasting holes are drilled in such a manner that they are close to each other. For this reason, these holes can be optimally blasted by a specific charge amount of about 0.1 $kg/cm^3$ to 0.25 $kg/cm^3$, and the three first-order blasting holes are blasted simultaneously. As a result, the amount of explosive can be reduced. In addition, as the second-order blasting hole (i.e., enlarged hole) is blasted in a state of four free surfaces as described later, it can be optimally blasted even at a specific charge amount of about 0.2 $kg/cm^3$ to about 0.35 $kg/cm^3$.

Figure 1A:
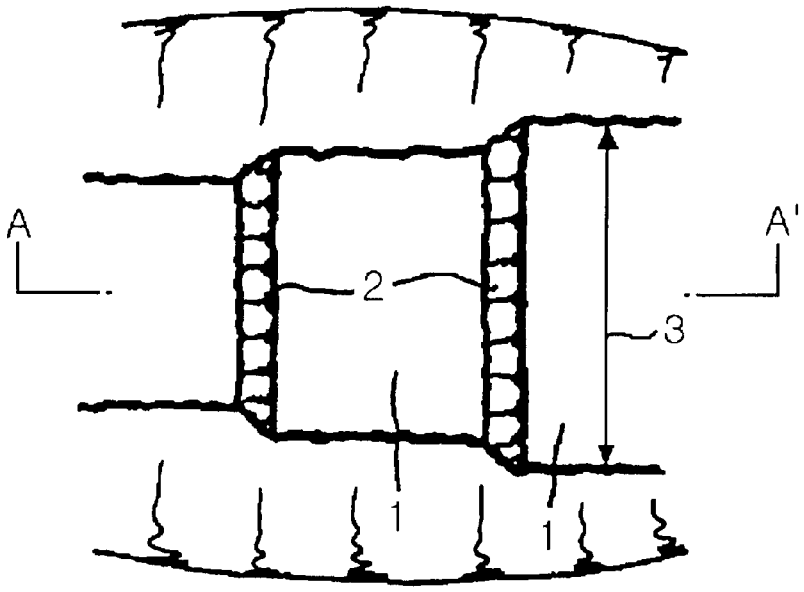
FIG. 1*a* is a plane view showing a general structure of a bench of rock with two free surfaces.
Figure 1B:
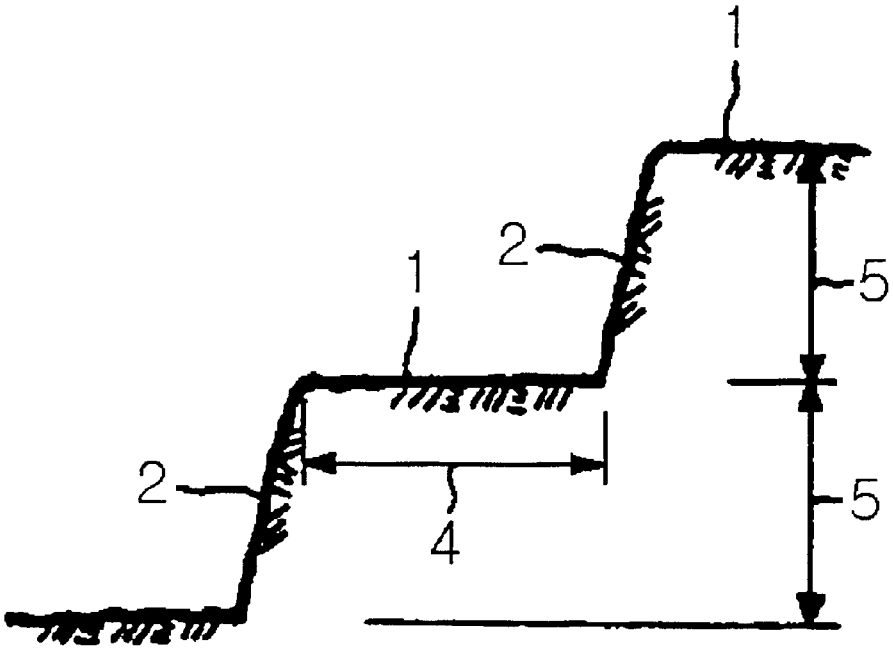
FIG. 1*b* is a cross-sectional view taken along the line A–A' in FIG. 1*a;*
Figure 2A:
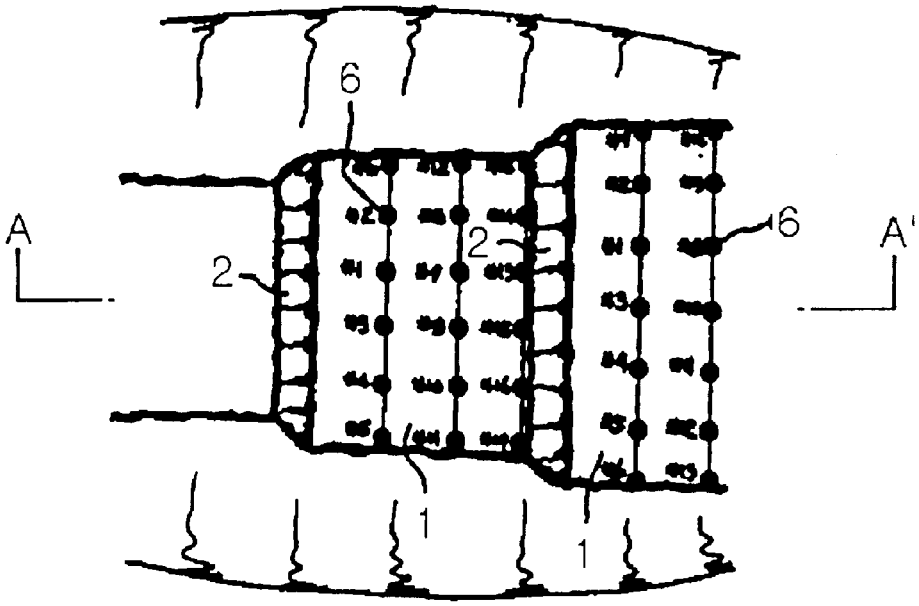
FIG. 2*a* is a plane view showing a downward drilling pattern according to the prior general blasting method of bench.
Figure 2B:
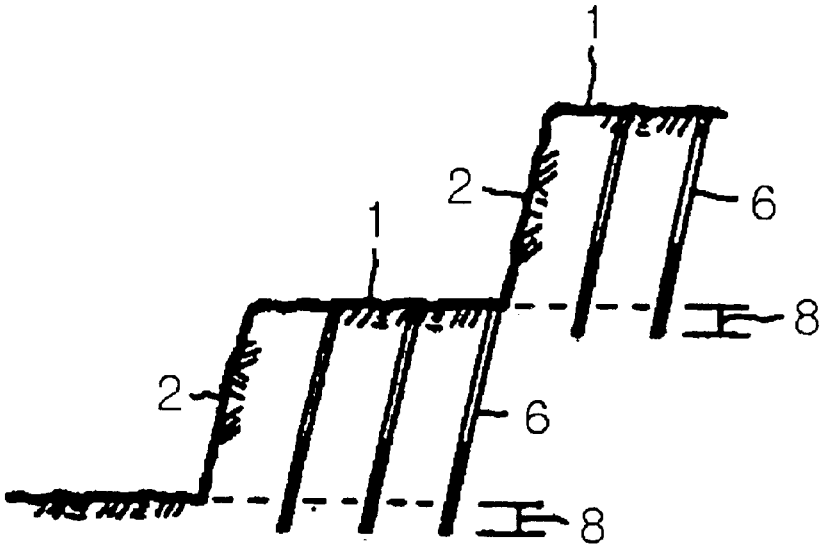
FIG.2b (PRIOR ART)
FIG. 2*b* is a cross-sectional view taken along the line A–A' of FIG. 2*a;*
Figure 3A:
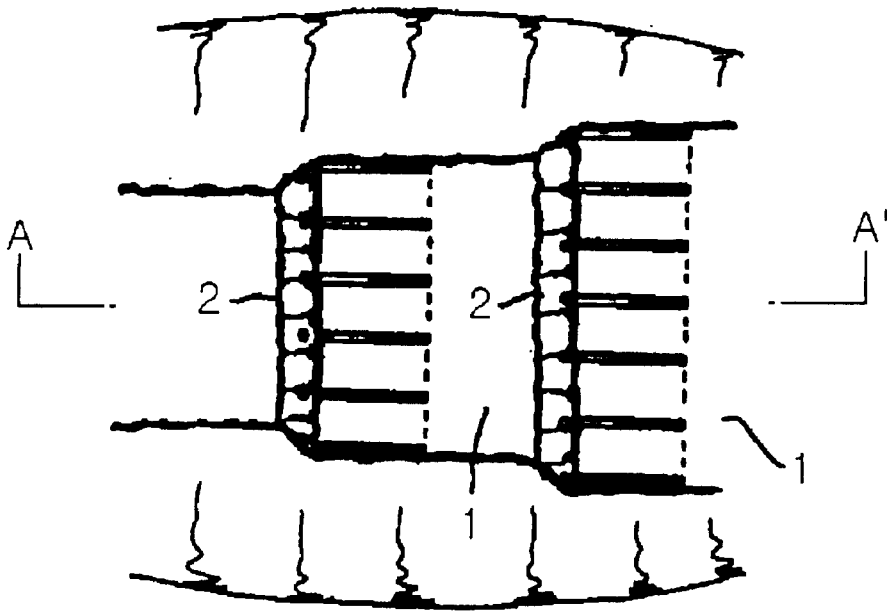
FIG. 3*a* is a plane view showing a horizontal drilling pattern according to the prior general blasting method of bench.
Figure 3B:
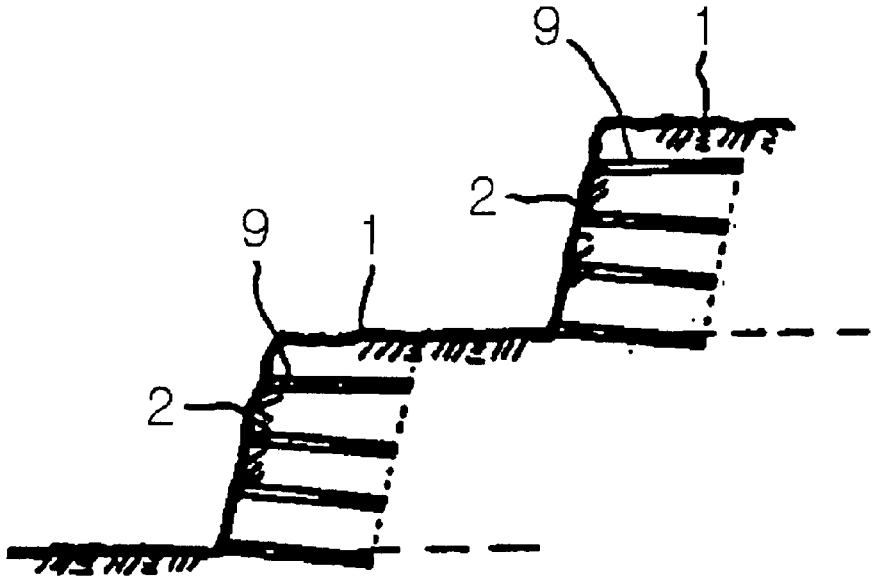
FIG. 3*b* is a cross-sectional view taken along the line A–A' of FIG. 3*a;*
Figure 4:
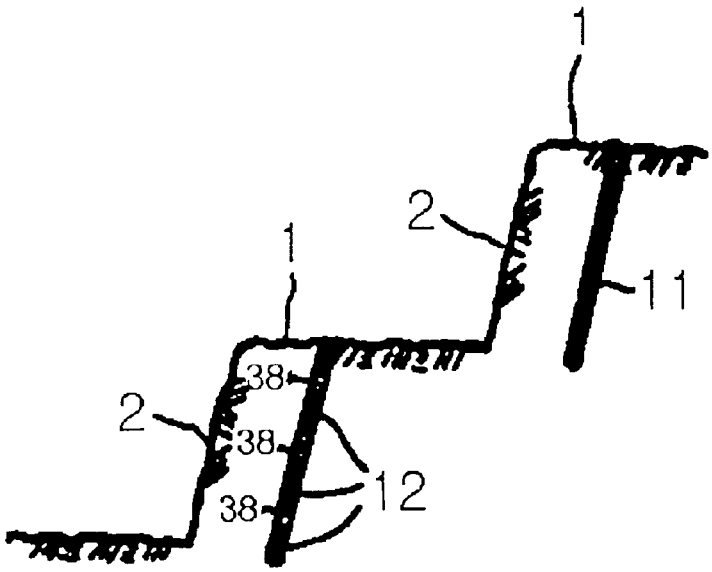
FIG. 4 is a cross-sectional view showing deck charge and rod-like charge in a blasting method of a downward drilling type.
Figure 5:
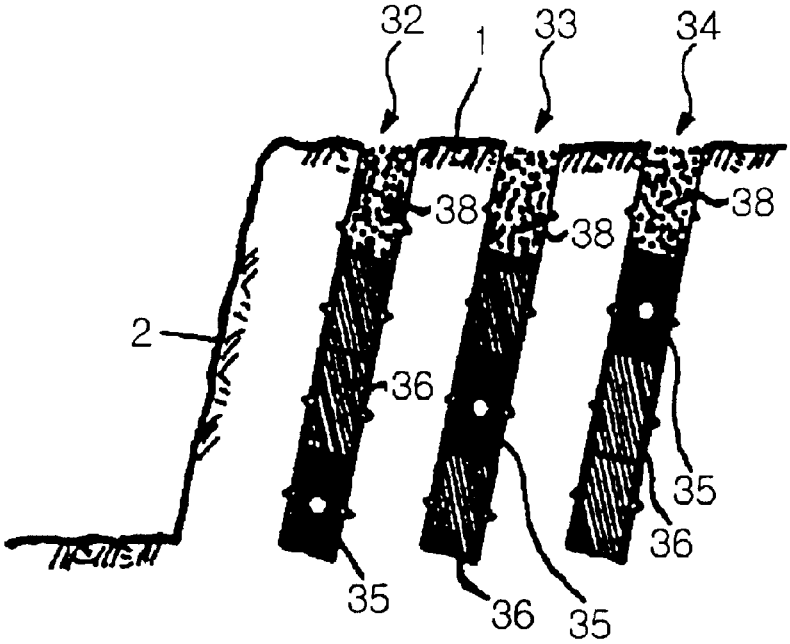
FIG. 5 is a cross-sectional view showing a position of a primer cartridge.

With respect to positioning of a primer cartridge 35, the delay blasting holes 14*a* and 14*b* must be charged in an indirect priming manner 32 as shown in FIG. 4 and the presplitting holes 13*a*, 13*b*, 13*c* and 13*d* and the second-order blasting hole 15 are charged in a middle priming manner or an indirect priming manner as shown in FIG. 4.

In the charging process, an electric or non-electric detonator with a delay time of 100 to 200 milliseconds (MS) is used, and a tamping is completely charged into an inlet of the holes.

After charging the holes with an explosive, a blasting process is carried out. In FIG. 6*a*, each numeral after the symbol "#" denotes a blasting sequence. The blasting process consists of a first-order blasting process and a second-order blasting process.

In the blasting process, the presplitting holes 13*a* and 13*b* of the first group of first-order blasting holes are successively blasted so as to form cracks around the delay blasting hole 14*a* which is then blasted. Thereafter, with a jump over the enlarged hole 15*a*, the presplitting holes 13*c* and 13*d* of the second group of first-order blasting holes are blasted so as to form cracks around the delay blasting hole 14*b*. The delay blasting hole 14*b* is then blasted, thereby forming four free surfaces in a castle shape around the enlarged hole 15*a*, whereby the first-order blasting process is completed.

Then, the enlarged hole 15*a* is blasted on the four free surfaces of the castle shape, whereby the second-order blasting is completed.

The first-order blasting process is carried out at a delay time of 10 MS to 200 MS. This is because, when the first-order blasting process is carried out with the delay time of 10 MS to 200 MS, the produced mucks have a constant size, blasting efficiency is maximized and stability is sufficient. However, if the blasting is conducted with a delay time of more than 200 MS, mucks are produced so as to have a large size and the delay effect is insufficient so that blasting is uneconomical. Also, a detonator with a delay time of less than 10 MS is not commercially available.

When tensile stress waves are returned, shear fracture occurs around the presplitting holes that are blasted first. Because of a time difference between the tensile stress waves returned from the two free surfaces, many cracks occur around the delay blasting holes 14*a* and 14*b*. Thus, rock restrained around the delay blasting hole is effectively pushed out so that four free surfaces are formed around the enlarged hole in a castle shape.

According to this embodiment, it is possible to reduce the charge amount per delay in the first-order blasting process of two free surfaces, and to conduct the blasting of four free surfaces in the second-order blasting process. Accordingly, blasting efficiency can be increased and also blasting nuisances including blasting vibration and blasting noise and the like can be significantly reduced.

In this embodiment, there were shown and illustrated an example of one row of blasting holes that consist of the first group of first-order blasting holes, the second-order blasting hole, and the second group of first-order blasting holes. However, if a bench to be blasted is relatively long, another row of blasting holes consisting of a first group of first-order blasting holes, a second-order blasting hole and a second group of first-order blasting holes may also be drilled, charged with explosives and blasted, as described above.

Embodiment 2

Figure 7A:
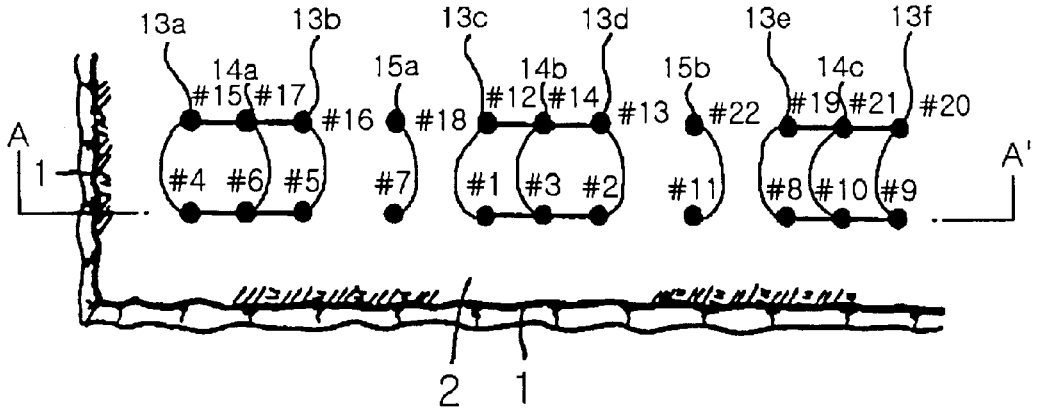
FIG. 7*a* is a plane view of a bench of rock, which indicates that the blasting mechanism according to the present invention is applied for the blasting of a bench of rock with relatively wide width and long length.
Figure 7B:
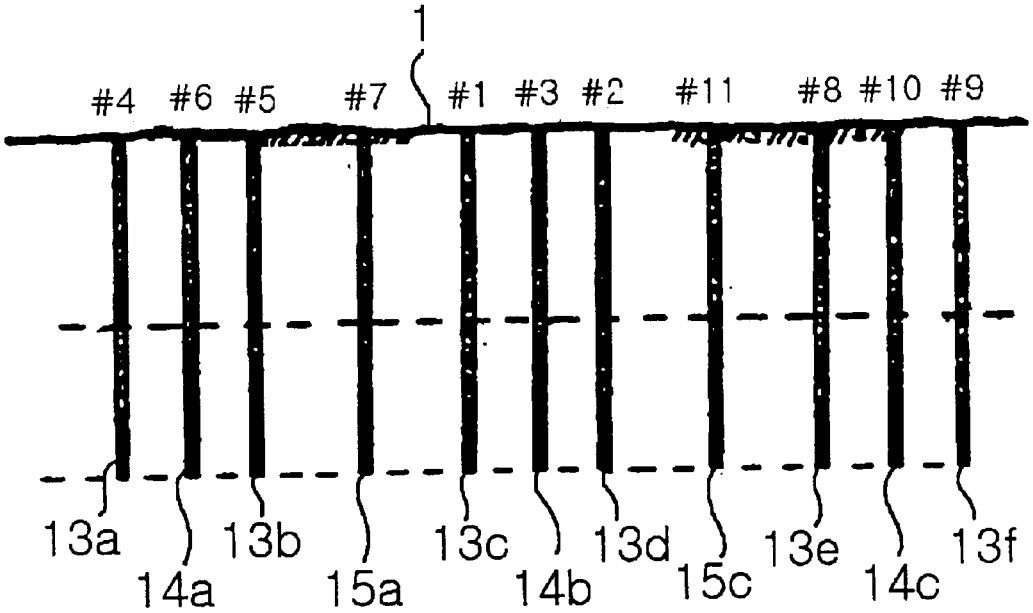
FIG. 7*b* is a cross-sectional view taken along the line A–A' in FIG. 7*a;*

FIG. 7*a* is a plane view of a bench of rock, which shows the blasting mechanism according to the present invention is applied for blasting of a bench of rock with relatively wide width and long length, and FIG. 7*b* is a cross-sectional view taken along the line A–A' in FIG. 7*a*.

Where a bench of rock to be blasted is wide and long, another second-order blasting hole (second enlarged hole) and a third group of first-order blasting holes are drilled in addition to the blasting holes of Embodiment 1. In other words, as shown in FIGS. 7*a* and 7*b*, two rows of blasting holes are drilled on an upper free surface of a bench with greater width and length than the bench of Embodiment 1. The respective rows of blasting holes consist of a first group of first-order blasting holes 13*a*, 14*a* and 13*b*, a first enlarged hole 15*a*, a second group of first-order blasting holes 13*c*, 14*b* and 13*d*, a second enlarged hole 15*b* and a third group of first-order blasting holes 13*e*, 14*c* and 13*f*. The respective groups of first-order blasting holes consist of two presplitting holes 13*a* and 13*b*, 13*c* and 13*d*, or 13*e* and 13*f*, and one delay blasting hole 14*a*, 14*b* or 14*c* placed between the presplitting holes. Moreover, these blasting holes are arranged in a straight line on the upper free surface.

In a drilling process, the interval between the presplitting holes and the delay blasting hole, and the interval between the presplitting holes and the enlarged holes, are the same as in Embodiment 1.

After drilling, the blasting holes are charged with explosives in the same manner as in the embodiment 1.

After charging the holes with explosive, a blasting process is carried out according to a blasting sequence expressed by each numeral after the symbol "#". In other words, the presplitting holes 13*a* and 13*b* of the first group of first-order blasting holes in the first row of blasting holes close to the vertical or slant free surface of the bench are successively blasted so as to form cracks around the delay blasting hole 14*a* which is then blasted. Thereafter, the second group of first-order blasting holes 13*c* and 13*d* are blasted so as to form cracks around the delay blasting hole 14*a*. The delay blasting hole 14*b* is then blasted, thereby forming four free surfaces in a castle shape around the first enlarged hole 15*a*. In this state of four free surfaces, the first enlarged hole 15*a* is blasted. Next, the third group of first-order blasting holes 13*e* and 13*f* are blasted so as to form cracks around the delay blasting hole 14*c*. The delay blasting hole 14*c* is then blasted, thereby forming four free surfaces in a castle shape around the second enlarged hole 15*b*. In this state of four free surfaces, the second enlarged hole 15*a* is blasted. In this way, a blasting process of the first row of blasting holes is completed. Then, a blasting process of the second row of blasting holes is carried out according to a blasting sequence as described above.

According to this embodiment, it is possible to reduce the charge amount per delay in the first-order blasting process of two free surfaces, and to conduct the blasting of four free surfaces in the second-order blasting process. Accordingly, blasting efficiency can be increased and also blasting nuisance including blasting vibration and blasting noise and the like can be significantly reduced.

Embodiment 3

Figure 8A:
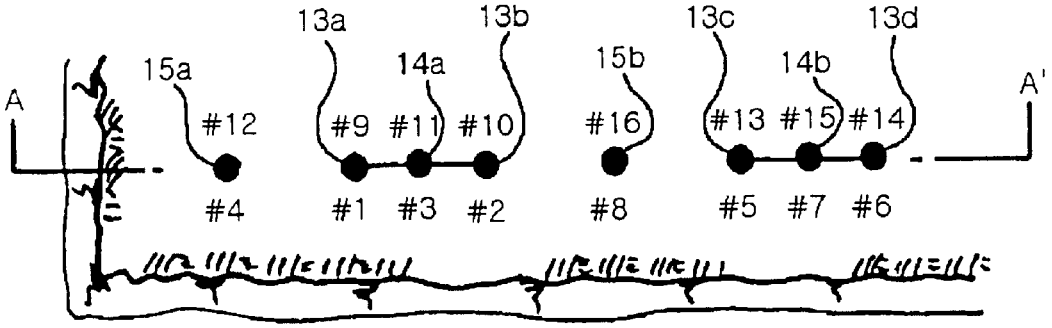
FIG. 8*a* is a plane view of a bench of rock, which indicates that the blasting mechanism of the present invention applied for the blasting of a bench of rock with a relatively long drilling depth.
Figure 8B:
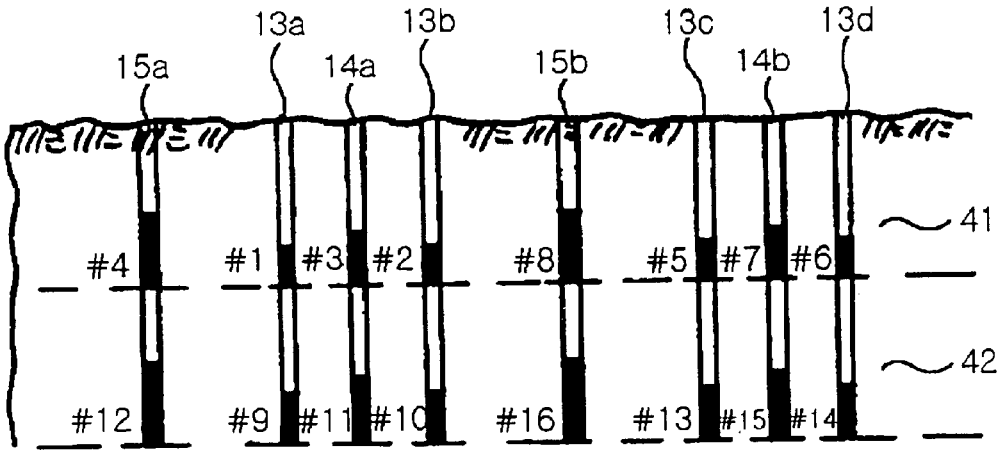
FIG. 8*b* is a cross-sectional view taken along the line A–A' in FIG. 8*a;*

FIG. 8*a* is a plane view of a bench of rock, which shows the blasting mechanism of the present invention applied to blasting of a bench of rock with a relatively long drilling depth, and FIG. 8*b* is a cross-sectional view taken along the line A–A' in FIG. 8*a*.

As shown in FIGS. 8*a* and 8*b*, a first enlarged hole 15*a*, a first group of first-order blasting holes 13*a*, 14*a* and 13*b*, a second enlarged hole 15*b* and a second group of first-order blasting holes 13*c*, 14*b* and 13*d* are drilled into an upper free surface of bench of rock. The respective groups of first-order blasting holes consist of two presplitting holes 13*a* and 13*b*, or 13*c* and 13*d*, and one delay blasting hole 14*a* or 14*b* placed between the presplitting holes.

In this drilling process, an interval between the presplitting holes and the delay blasting hole; and an interval between the respective enlarged holes and the presplitting holes adjacent thereto, are the same as in Embodiment 1.

Thereafter, the blasting holes are charged with explosives. As generally known in the art, where the drilling depth is long, rod-like charge must be carried out and hence a charge amount per delay will be increased. For this reason, as shown in FIG. 8*b*, the respective blasting holes are charged in the deck charge manner at two portions, namely first portions 41 and second sections 42, divided in the drilling length-wise direction. Contrary to rod-like charge, such a deck charge allows the charge amount per delay to be dispersed and thus enables blasting nuisances in the subsequent blasting process to be significantly reduced.

After charging, the first portions 41 and the second portions 42 of the respective holes are separately blasted. In other words, as shown in FIG. 8*b*, the first portions 41 are blasted according to blasting sequence expressed by each numeral after the symbol "#", and then the second portions 42 are blasted according to the blasting sequence. The first portions 41 of the presplitting holes 13*a* and 13*b* in the first group of first-order blasting holes are blasted so as to form cracks around the delay blasting hole 14*a*. Then, the delay blasting hole 14*a* is blasted so as to form four free surfaces around the first enlarged hole 15*a*. In this state of four free surfaces, the first enlarged hole 15*a* is blasted. Then, the presplitting holes 13*c* and 13*d* of the second group of first-order blasting holes are blasted so as to form cracks around the delay blasting hole 14*b*. Then, the delay blasting hole 14*b* is blasted so as to form four free surfaces around the second enlarged hole 15*b*. In this state of four free surfaces, the second enlarged hole 15*b* is blasted, whereby blasting of the first portions 41 is completed. Then, blasting of the second portions is carried out in the same blasting sequence as described above for blasting of the first portions 41.

In this embodiment, the deck charge is carried out, so that the charge amount per delay is significantly reduced. In addition, it is possible to reduce the charge amount per delay in the first-order blasting process of two free surfaces, and to conduct the blasting of four free surfaces in the second-order blasting process. Accordingly, blasting efficiency can be increased and also blasting nuisances such as blasting vibration and blasting noise and the like can be significantly reduced.

Embodiment 4

Figure 9A:
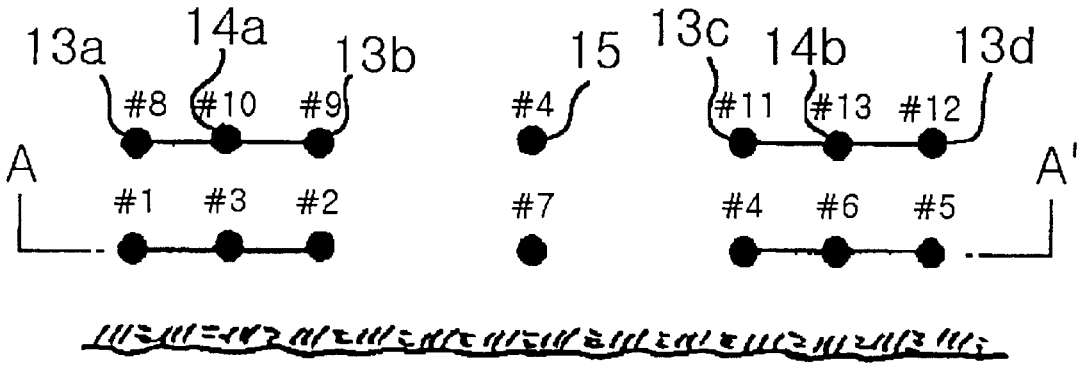
FIG. 9*a* is a plane view of a bench of rock, which indicates that the blasting mechanism of the present invention is applied for the blasting of a bench of rock with relatively long length and wide width.
Figure 9B:
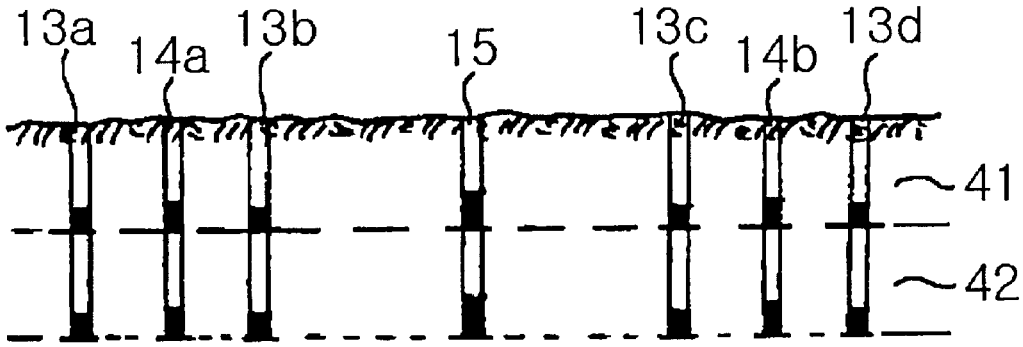
FIG. 9*b* is a cross-sectional view taken along the line A–A' in FIG. 9*a.*

FIG. 9*a* is a plane view of a bench of rock, which shows that the blasting mechanism of the present invention is applied for blasting of a bench of rock with relatively long length and wide width, and FIG. 9*b* is a cross-sectional view taken along the line A–A' in FIG. 9*a*.

Blasting holes are drilled so as to have a drilling pattern as shown in FIGS. 9*a* and 9*b*. In this drilling process, an interval between presplitting holes 13*a* and 13*b*, or 13*c* and 13*d* and the delay blasting hole 14*a* or 14*b*, and an interval between an enlarged hole 15 and the presplitting holes adjacent thereto, are the same as in Embodiment 1.

After drilling, the blasting holes are charged with explosives in the deck charge manner as described in Embodiment 3.

Thereafter, the blasting holes are blasted according to the same blasting sequence as described in Embodiments 1 and 3. In other words, first portions 41 are blasted and then second portions 42 are blasted. In blasting the respective portions, the first portions 41 of the presplitting holes 13*a* and 13*b* in the first group of first-order blasting holes are blasted so as to form cracks around the delay blasting hole 14*a*. Then, the presplitting holes 13*c* and 13*d* of the second group of first-order blasting holes are blasted so as to form cracks around the delay blasting hole 14*b*. Then, the delay blasting hole 14*b* is blasted so as to form four free surfaces around the enlarged hole 15. In this state of four free surfaces, the enlarged hole 15*b* is blasted, whereby blasting of the first portion 41 in a first row of blasting holes is completed. Then, blasting of the second portions in a second row of blasting holes is carried out in the same blasting sequence as described above for blasting of the first portions 41. Next, blasting of the second row of blasting holes is carried out according to the same manner as described above.

Table 1 below indicates conditions and results of test blasting carried out according to this embodiment.

TABLE 1

| Conditions and results of operation | |
|---|---|
| Equipment | Crawler drill |
| Drilling diameter | 45 mm |
| Drilling length | 2.7 m |
| Number of holes | 14 |
| Interval between holes | 0.9 m and 1.8 m |
| Burden | 1.0 m |
| Blasting volume | 37.7 $m^3$ |

TABLE 1-continued

| Conditions and results of operation | | |
|---|---|---|
| Blasting efficiency | | 97% |
| Specific charge amount | | 0.23 kg/m$^3$ |
| Specific drilling length | | 1.0 m/m$^3$ |
| Blasting vibration | | 47% |
| Working hours | Drilling | 246 minutes |
| | Charge/Blasting | 371 minutes |
| Blasting expenses (won/m$^3$) | | |
| Personnel expenses | | 8,724 won/m$^3$ |
| Material cost | | 2,640 won/m$^3$ |
| Equipment cost | | 3,351 won/m$^3$ |
| Total | | 14,715 won/m$^3$ |

COMPARATIVE EXAMPLE 1

This example is given for comparison of the results of Embodiment 4 with results obtained by a blasting method of a bench of rock according to the prior art.

Figure 10A:
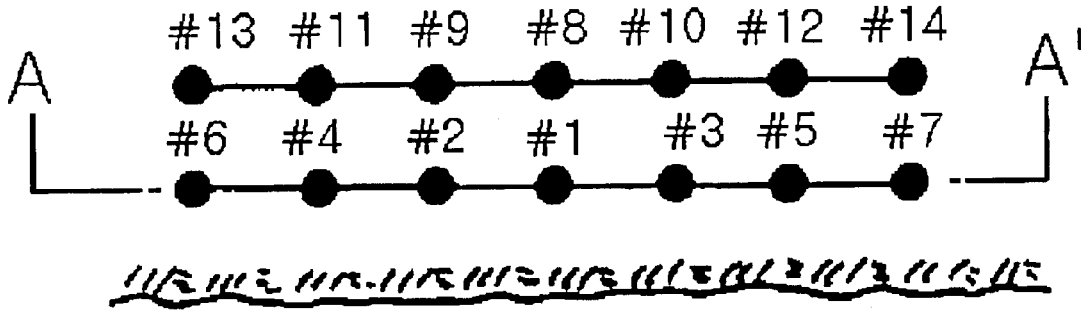
FIG. 10*a* is a plane view showing a blasting method of a bench of rock according to the prior art.
Figure 10B:
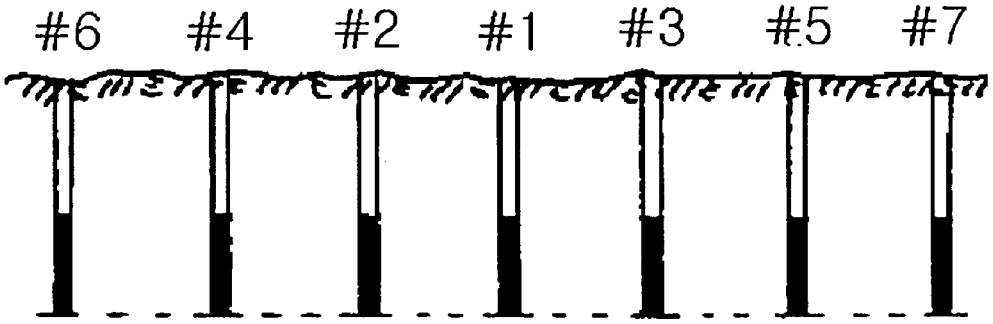
FIG.10b (PRIOR ART)
FIG. 10*b* is a cross-sectional view taken along the line A–A' in FIG. 10*a;*

FIG. 10*a* is a plane view showing a blasting method of a bench of rock according to the prior art, and FIG. 10*b* is a cross-sectional view taken along the line A–A' in FIG. 10*a*. As shown in FIGS. 10*a* and 10*b*, blasting holes are drilled on a bench of two free surfaces at intervals of 1.2 meters. In this case, the bench has the substantially same length and width as in Embodiment 4. Then, the blasting holes are charged with explosives and blasted. In the blasting process, one blasting hole positioned at the central portion of the bench of two free surfaces is first blasted so as to form three free surfaces, after which blasting holes on both sides of the central blasting holes are successively blasted. The blasting sequence of the holes is expressed by each numeral after the symbol "#" in FIG. 10*a*.

Table 2 below indicates conditions and results of test blasting carried out according to this comparative example.

TABLE 2

| Conditions and results of operation | | |
|---|---|---|
| Equipment | | Crawler drill |
| Drilling diameter | | 45 mm |
| Drilling length | | 2.7 m |
| Number of holes | | 14 |
| Interval between holes | | 1.2 m |
| Burden | | 1.0 m |
| Blasting volume | | 36.5 m$^3$ |
| Blasting efficiency | | 94% |
| Specific charge amount | | 0.38 kg/m$^3$ |
| Specific drilling length | | 1.04 m/m$^3$ |
| Blasting vibration | | 100% |
| Working hours | Drilling | 254 minutes |
| | Charge/Blasting | 382 minutes |
| Blasting expenses (won/m$^3$) | | |
| Personnel expenses | | 10,569 won/m$^3$ |
| Material cost | | 3,249 won/m$^3$ |
| Equipment cost | | 4,522 won/m$^3$ |
| Total | | 18,340 won/m$^3$ |

Embodiment 5

Figure 11A:
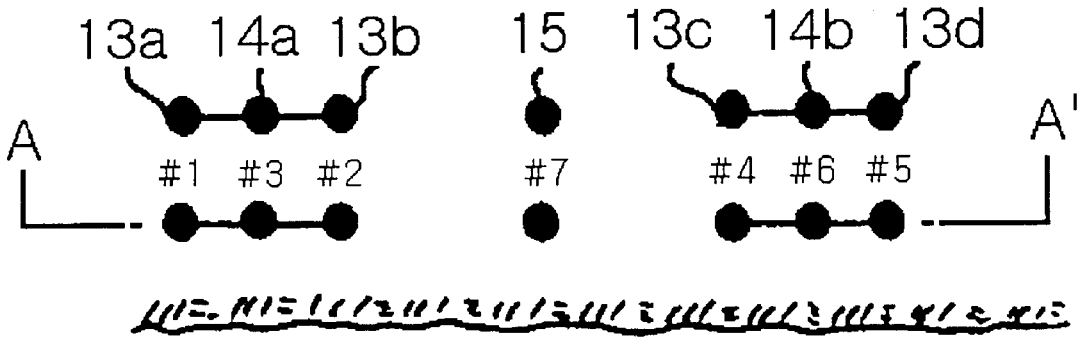
FIG. 11*a* is a plane view of a bench of rock, which shows the blasting mechanism of the present invention applied for blasting of a bench of rock with an average width.
Figure 11B:
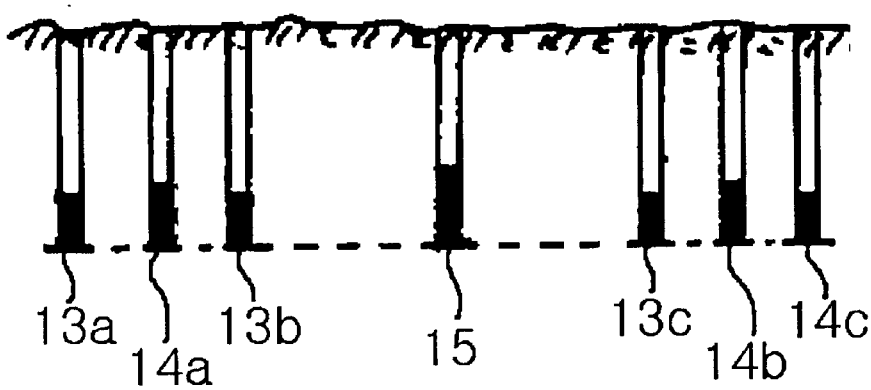
FIG. 11*b* is a cross-sectional view taken along the line A–A' in FIG. 11*a;*

FIG. 11*a* is a plane view of a bench of rock, which indicates that the blasting mechanism of the present invention is applied for blasting of a bench of rock with an average width, and FIG. 11*b* is a cross-sectional view taken along the line A–A' in FIG. 11*a*.

Blasting holes are drilled so as to have a drilling pattern as shown in FIGS. 11*a* and 11*b*. In the drilling process, an interval between the presplitting holes 13*a* and 13*b*, or 13*c* and 13*d* and the delay blasting hole 14*a* or 14*b* is 0.5 meters, and an interval between the enlarged hole 15 and the respective presplitting holes adjacent thereto is 0.75 meters. Thereafter, charge and blasting are carried out in the same manner as described in Embodiment 1.

Table 3 below indicates conditions and results of test blasting carried out according to this Embodiment.

TABLE 3

| Conditions and results of operation | | |
|---|---|---|
| Equipment | | Leg drill |
| Drilling diameter | | 38 mm |
| Drilling length | | 1.2 m |
| Number of holes | | 14 |
| Interval between holes | | 0.5 m and 0.75 m |
| Blasting volume | | 7.12 m$^3$ |
| Blasting efficiency | | 97% |
| Specific charge amount | | 0.45 kg/m$^3$ |
| Specific drilling length | | 2.4 m/m$^3$ |
| Blasting vibration | | 34% |
| Working hours | Drilling | 114 minutes |
| | Charge/Blasting | 165 minutes |
| Blasting expenses (won/m$^3$) | | |
| Personnel expenses | | 3,002 won/m$^3$ |
| Material cost | | 2,459 won/m$^3$ |
| Equipment cost | | 3,721 won/m$^3$ |
| Total | | 9,182 won/m$^3$ |

COMPARATIVE EXAMPLE 2

This comparative example is given for comparison of the results of Embodiment 5 with results obtained by a blasting method of a bench of rock according to the prior art.

Figure 12A:
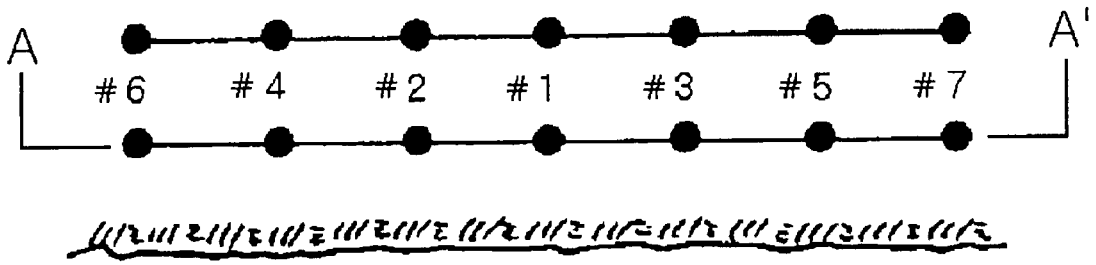
FIG.12a (PRIOR ART)
FIG. 12*a* is a plane view showing a low vibration blasting method of a bench of rock according to the prior art.
Figure 12B:
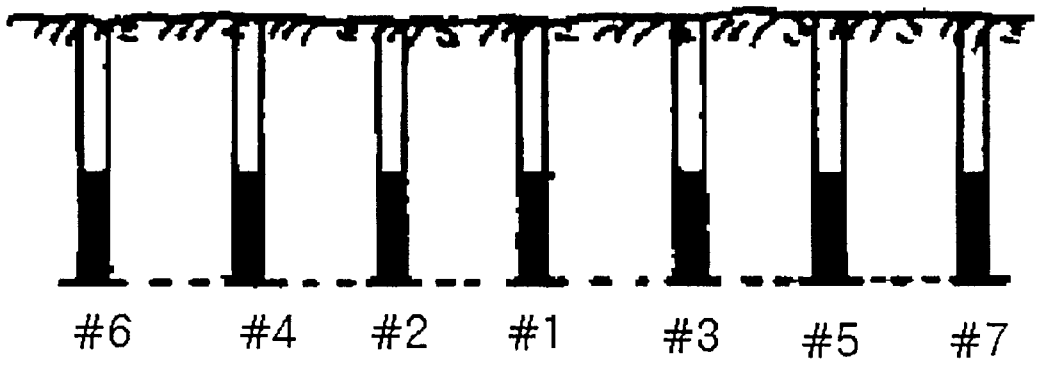
FIG.12b (PRIOR ART)
FIG. 12*b* is a cross-sectional view taken along the line A–A' in FIG. 12*a;*

FIG. 12*a* is a plane view showing a low vibration blasting method of a bench of rock according to the prior art, and FIG. 12*b* is a cross-sectional view taken along the line A–A' in FIG. 12*a*. As shown in FIGS. 12*a* and 12*b*, blasting holes are drilled on a bench of two free surfaces at intervals of 0.6 meters. In this case, the bench has essentially the same width as in Embodiment 4. Then, the blasting holes are charged with explosives and blasted. In the blasting process, one blasting hole positioned at the central portion of the bench with two free surfaces is first blasted so as to form three free surfaces, after which blasting holes on both sides of the central blasting holes are blasted. The blasting sequence of the blasting holes is expressed by each numeral after the symbol "#" in FIGS. 12*a* and 12*b*.

Table 4 below indicates conditions and results of test blasting carried out according to this comparative example.

TABLE 4

| Conditions and results of operation | |
|---|---|
| Equipment | Leg drill |
| Drilling diameter | 38 mm |
| Drilling length | 1.2 m |
| Number of holes | 14 |
| Interval between holes | 0.6 m |
| Blasting volume | 6.09 m$^3$ |
| Blasting efficiency | 94% |
| Specific charge amount | 0.69 kg/m$^3$ |

TABLE 4-continued

| Conditions and results of operation | | |
|---|---|---|
| Specific drilling length | | 2.5 m/m$^3$ |
| Blasting vibration | | 95% |
| Working hours | Drilling | 117 minutes |
| | Charge/Blasting | 176 minutes |
| Blasting expenses (won/m$^3$) | | |
| Personnel expenses | | 3,021 won/m$^3$ |
| Material cost | | 2,359 won/m$^3$ |
| Equipment cost | | 3,997 won/m$^3$ |
| Total | | 9,337 won/m$^3$ |

Embodiment 6

Figure 13A:
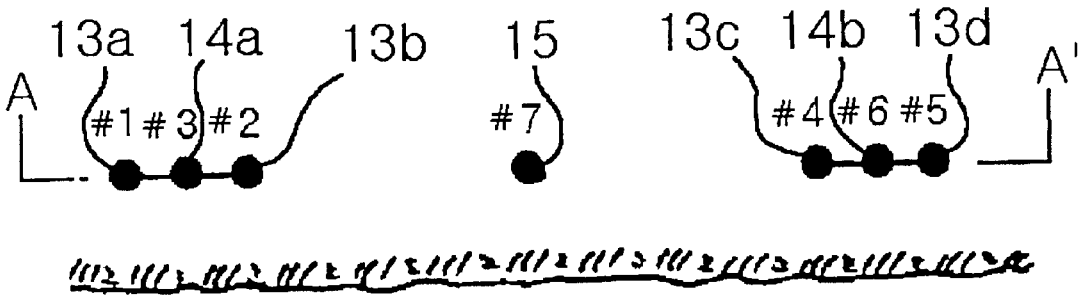
FIG. 13*a* is a plane view of a bench of rock, which indicates that the blasting mechanism of the present invention is applied in the blasting of a bench of rock which is carried out for the production of large mucks.
Figure 13B:
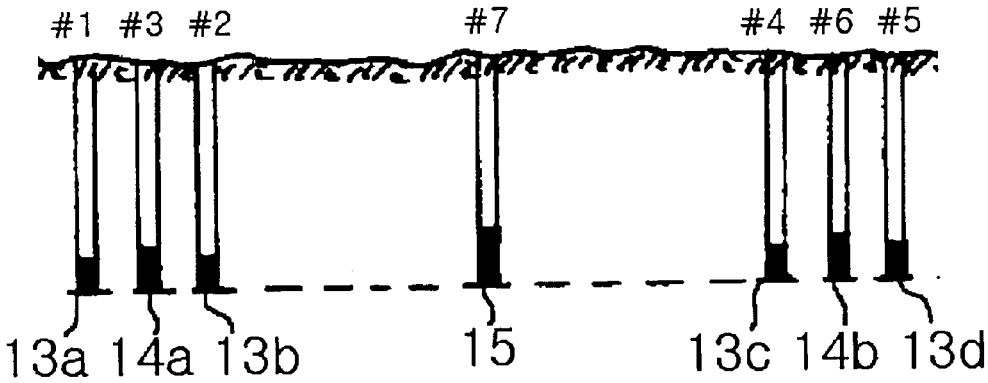
FIG. 13*b* is a cross-sectional view taken along the line A–A' in FIG. 13*a;*

FIG. 13*a* is a plane view of a bench of rock, which indicates that the blasting mechanism of the present invention is applied in blasting a bench of rock for production of large mucks, and FIG. 13*b* is a cross-sectional view taken along the line A–A' in FIG. 13*a*.

Blasting holes are drilled so as to have a drilling pattern as shown in FIGS. 13*a* and 13*b*, after which the blasting holes are charged with explosives and blasted in the same manner as described in Embodiment 1. In the drilling process, however, an interval between the enlarged hole 15 and a presplitting hole 13*b* or 13*c* adjacent thereto is larger than that in Embodiment 1, whereby large mucks are produced in the subsequent blasting process. In other words, as shown in FIGS. 13*a* and 13*b*, the respective groups of first-order blasting holes 13*a*, 14*a* and 13*b* are drilled at intervals of 0.3 meters, apart from a slant free surface at a distance of 1.0 meter. Also, the second-order blasting hole 15 is drilled apart from the presplitting hole 13*b* or 13*c* adjacent thereto. The enlarged hole 15 is blasted on four free surfaces, so that large mucks with a size of 1.2 m$^3$ can be produced in an easy manner.

Table 5 below indicates conditions and results of test blasting carried out according to this Embodiment.

TABLE 5

| Conditions and results of operation | | |
|---|---|---|
| Equipment | | Crawler drill |
| Drilling diameter | | 45 mm |
| Drilling length | | 2.7 m |
| Number of holes | | 7 |
| Interval between holes | | 0.3 m and 3.0 m |
| Blasting volume | | 7.1 m$^3$ |
| Muck size | | 1.2 m$^3$ |
| Specific charge amount | | 0.22 kg/m$^3$ |
| Specific drilling length | | 0.63 m/m$^3$ |
| Blasting efficiency | | 97% |
| Blasting vibration | | 56% |
| Working hours | Drilling | 591.27 minutes |
| | Charge/Blasting | 891.43 minutes |
| Blasting expenses (won/m$^3$) | | |
| Personnel expenses | | 8,704.7 won/m$^3$ |
| Material cost | | 2,520.3 won/m$^3$ |
| Equipment cost | | 3,351.2 won/m$^3$ |
| Total | | 14,576.2 won/m$^3$ |

COMPARATIVE EXAMPLE 3

This example is given for comparison of the results of Embodiment 4 with results obtained by a blasting method of a bench of rock according to the prior art.

Figure 14A:
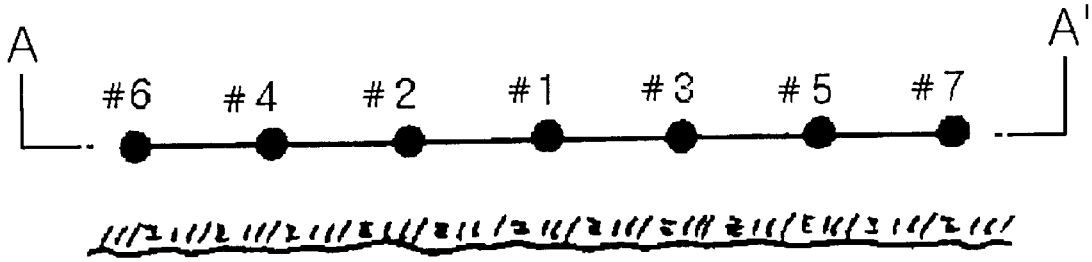
FIG. 14a (PRIOR ART)
FIG. 14*a* is a plane view showing a blasting method of a bench of rock according to the prior art which is carried out for production of large mucks.
Figure 14B:
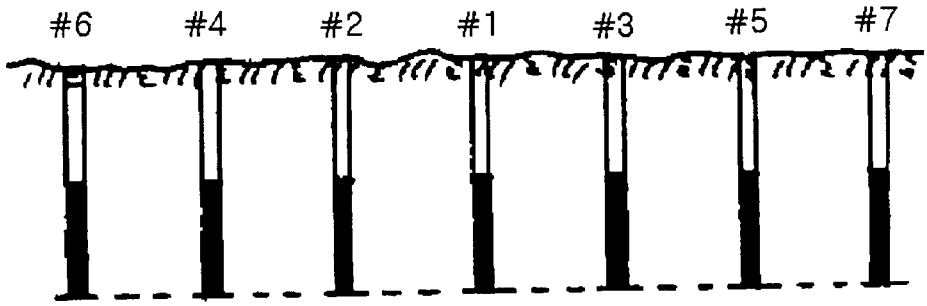
FIG. 14b (PRIOR ART)
FIG. 14*b* is a cross-sectional view taken along the line A–A' in FIG. 14*a.*

FIG. 14*a* is a plane view showing a blasting method of a bench of rock according to the prior art which is carried out for production of large mucks, and FIG. 14*b* is a cross-sectional view taken along the line A–A' in FIG. 14*a*. As shown in FIGS. 14*a* and 14*b*, blasting holes are drilled on a bench of two free surfaces at intervals of 1.2 meters. In this case, the bench has essentially the same width as that of Embodiment 6. Then, the blasting holes are charged with explosives and blasted. In the blasting process, one blasting hole #1 positioned at the central portion of the bench of two free surfaces is first blasted so as to form three free surfaces, after which blasting holes on both sides of the central blasting hole #1 are successively blasted. The blasting sequence of the holes is expressed by each numeral after the symbol "#" in FIG. 10*a*.

Table 6 below indicates conditions and results of test blasting carried out according to this comparative example.

TABLE 6

| Conditions and results of operation | | |
|---|---|---|
| Equipment | | Crawler drill |
| Drilling diameter | | 45 mm |
| Drilling length | | 2.7 m |
| Number of holes | | 7 |
| Interval between holes | | 1.2 m |
| Blasting volume | | 7.2 m$^3$ |
| Muck size | | 0.8 m$^3$ |
| Specific charge amount | | 0.31 kg/m$^3$ |
| Specific drilling length | | 0.65 m/m$^3$ |
| Blasting efficiency | | 95% |
| Blasting vibration | | 100% |
| Working hours | Drilling | 600.29 minutes |
| | Charge/Blasting | 900.44 minutes |
| Blasting expenses (won/m$^3$) | | |
| Personnel expenses | | 10,789.4 won/m$^3$ |
| Material cost | | 3,146.5 won/m$^3$ |
| Equipment cost | | 4,522.4 won/m$^3$ |
| Total | | 18,458.8 won/m$^3$ |

Embodiment 7

Figure 15A:
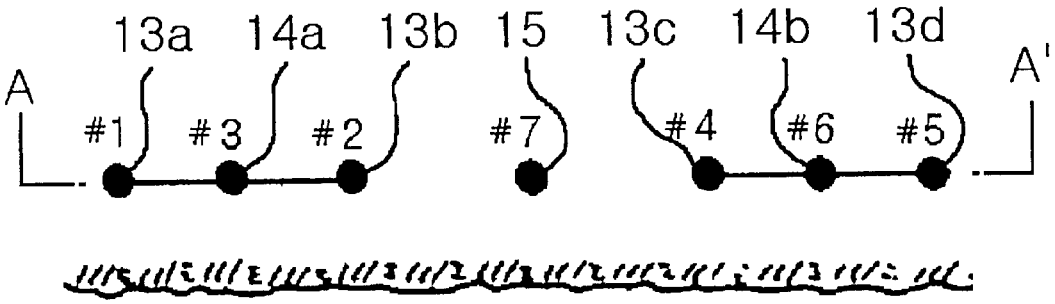
FIG. 15*a* is a plane view of a bench of rock, which illustrates that the blasting mechanism of the present invention is applied in blasting of a bench of rock for production of small mucks.
Figure 15B:
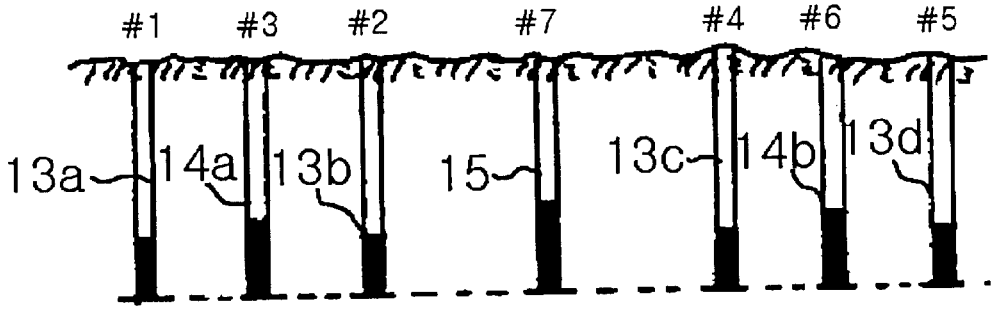
FIG. 15*b* is a cross-sectional view taken along the line A–A' in FIG. 15*a;*

FIG. 15*a* is a plane view of a bench of rock, which illustrates that the blasting mechanism of the present invention is applied in blasting a bench of rock for production of small mucks, and FIG. 15*b* is a cross-sectional view taken along the line A–A' in FIG. 15*a*.

Blasting holes are drilled so as to have a drilling pattern as shown in FIGS. 15*a* and 15*b*, after which the blasting holes are charged with explosives and blasted in the same manner as described in Embodiment 1. In the drilling process, however, an interval between the enlarged hole 15 and presplitting holes 13*b* and 13*c* adjacent thereto is shorter than that in Embodiment 1, whereby small mucks are produced in the subsequent blasting process. In other words, as shown in FIGS. 15*a* and 15*b*, the respective groups of first-order blasting holes 13*a*, 14*a* and 13*b* are drilled at intervals of 1.0 meter, apart from a slant free surface at a distance of 1.0 meter. Also, the second-order blasting hole (enlarged hole) 15 is drilled apart from the adjacent presplitting hole 13*b* or 13*c* adjacent thereto at a distance of 1.6 meters. The blasting process is carried out in the same manner as described in Embodiment 1.

Table 7 below indicates conditions and results of test blasting carried out according to this Embodiment.

TABLE 7

| Conditions and results of operation | | |
|---|---|---|
| Equipment | | Crawler drill |
| Drilling diameter | | 45 mm |
| Drilling length | | 2.7 m |
| Number of holes | | 7 |
| Interval between holes | | 1.0 m and 1.6 m |
| Blasting volume | | 7.1 $m^3$ |
| Muck size | | 0.3 $m^3$ |
| Specific charge amount | | 0.22 $kg/m^3$ |
| Specific drilling length | | 0.63 $m/m^3$ |
| Blasting efficiency | | 97% |
| Blasting vibration | | 56% |
| Working hours | Drilling | 591.27 minutes |
| | Charge/Blasting | 891.43 minutes |
| Blasting expenses ($won/m^3$) | | |
| Personnel expenses | | 8,704.7 $won/m^3$ |
| Material cost | | 2,520.3 $won/m^3$ |
| Equipment cost | | 3,351.2 $won/m^3$ |
| Total | | 14,576.2 $won/m^3$ |

COMPARATIVE EXAMPLE 3

This example is given for comparison of the results of Embodiment 7 with results obtained by a blasting method of a bench of rock according to the prior art.

Figure 16A:
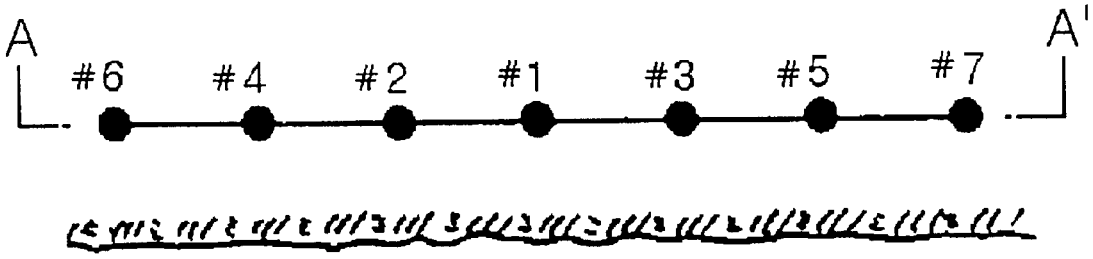
FIG.16a (PRIOR ART)
FIG. 16*a* is a plane view showing a blasting method of a bench of rock according to the prior art which is carried out for production of small mucks.
Figure 16B:
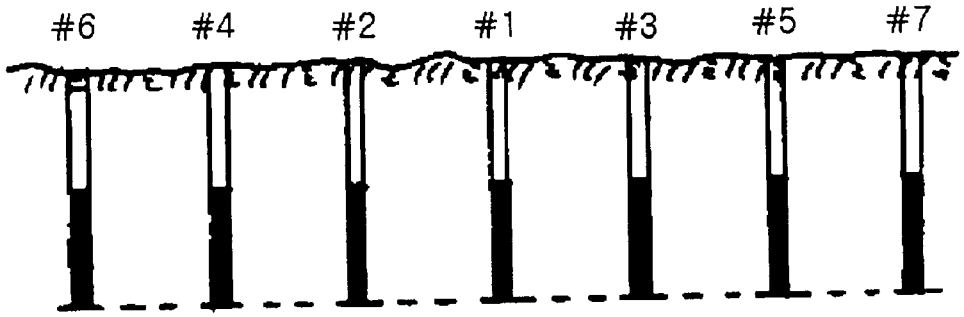
FIG. 16*b* is a cross-sectional view taken along the line A–A' in FIG. 16*a.*

FIG. 16*a* is a plane view showing a blasting method of a bench of rock according to the prior art which is carried out for the production of small mucks, and FIG. 16*b* is a cross-sectional view taken along the line A–A' in FIG. 16*a*. As shown in FIGS. 16*a* and 16*b*, blasting holes are drilled on a bench of two free surfaces at intervals of 1.2 meters. In this case, the bench has essentially the same width as that of Embodiment 7. Then, the blasting holes are charged with explosives and blasted. In the blasting process, one blasting hole #1 positioned at the central portion of the bench of two free surfaces is first blasted so as to form three free surfaces, after which blasting holes on both sides of the central blasting hole #1 are successively blasted. The blasting sequence of the holes is expressed by each numeral after the symbol "#" in FIGS. 16*a* and 16*b*.

Table 8 below indicates conditions and results of test blasting carried out according to this comparative example.

TABLE 8

| Conditions and results of operation | | |
|---|---|---|
| Equipment | | Crawler drill |
| Drilling diameter | | 45 mm |
| Drilling length | | 2.7 m |
| Number of holes | | 7 |
| Interval between holes | | 1.2 m |
| Blasting volume | | 7.2 $m^3$ |
| Muck size | | 0.8 $m^3$ |
| Specific charge amount | | 0.31 $kg/m^3$ |
| Specific drilling length | | 0.65 $m/m^3$ |
| Blasting efficiency | | 95% |
| Blasting vibration | | 100% |
| Working hours | Drilling | 600.29 minutes |
| | Charge/Blasting | 900.44 minutes |
| Blasting expenses ($won/m^3$) | | |
| Personnel expenses | | 10,789.9 $won/m^3$ |
| Material cost | | 3,146.5 $won/m^3$ |
| Equipment cost | | 4,522.4 $won/m^3$ |
| Total | | 18,458.8 $won/m^3$ |

Embodiment 8

Figure 17C:
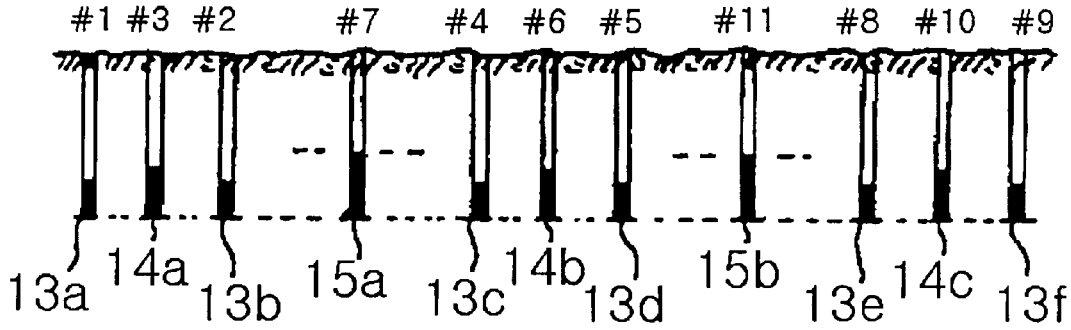

FIG. 17*a* is a perspective view of a bench of rock, which indicates that the blasting mechanism of the present invention is applied in a presplitting blasting method for the formation of a slope, FIG. 17*b* is a plane view showing each of rows of blasting holes formed at the bench of FIGS. 17*a*, and 17*c* is a cross-sectional view taken along the line A–A' in FIG. 17*b*.

As shown in FIG. 17*a*, four rows of blasting holes 110, 120, 130 and 140 are drilled downward on an upper free surface of a bench of sloped rock. The respective rows of blasting holes are drilled, charged with explosives and then blasted, in the same manner as described in Embodiment 1. In the blasting process, in order to cleanly blast the bench without damaging the slope of rock to be formed, the fourth row of blasting holes 140 in the four rows of blasting holes are first blasted. Following this, the first row of blasting holes 110, the second row of blasting holes 120 and the third row of blasting holes 130 are successively blasted. For the respective rows of blasting holes, a drilling interval, a charge amount and a blasting sequence are the same as described in Embodiment 1.

Table 9 below indicates conditions and results of test blasting carried out according to this embodiment.

TABLE 9

| Conditions and results of operation | | |
|---|---|---|
| Equipment | | Crawler drill |
| Drilling diameter | | 45 mm |
| Drilling length | | 2.7 m |
| Number of holes | | 11 |
| Interval between holes | | 1.0 m and 1.5 m |
| Blasting volume | | Cracks |
| Charge amount | | 14.5 kg |
| Blasting efficiency | | 100% |
| Blasting vibration | | 28% |
| Working hours | Drilling | 210 minutes |
| | Charge/Blasting | 292 minutes |
| Blasting expenses ($won/m^3$) | | |
| Personnel expenses | | 2,901 $won/m^3$ |
| Material cost | | 840 $won/m^3$ |
| Equipment cost | | 1,117 $won/m^3$ |
| Total | | 4,858 $won/m^3$ |

COMPARATIVE EXAMPLE 5

This example is given for comparison of the results of Embodiment 8 with results obtained by a presplitting blasting method of a bench of rock for formation of a slope according to the prior art.

FIG. 18*a* is a plane view showing a presplitting blasting method of a bench of rock according to the prior art, and FIG. 18*b* is a cross-sectional view taken along the line A–A' in FIG. 18*a*. As shown in FIGS. 18*a* and 18*b*, blasting holes are drilled into a bench of rock with two free surfaces at intervals of 1.2 meters. In this case, the bench has essentially the same width and length as in Embodiment 8. Then, the blasting holes are charged with explosives with a jump over one blasting hole without charging all the blasting holes. In the charging process, 3.0 kg of explosives are charged for every 2.7 m of drilling. Then, the blasting holes are blasted. In the blasting process, one blasting hole #1 positioned at the central portion of the bench with two free surfaces is first blasted so as to form three free surfaces, after which blasting holes on both sides of the central blasting hole #1 are successively blasted. The blasting sequence of the holes is expressed by each numeral after the symbol "#" in FIGS. 18*a* and 18*b*.

Table 10 below indicates conditions and results of test blasting carried out according to this comparative example.

TABLE 10

| Conditions and results of operation | | |
|---|---|---|
| Equipment | | Crawler drill |
| Drilling diameter | | 45 mm |
| Drilling length | | 2.7 m |
| Number of holes | | 11 |
| Interval between holes | | 1.2 m |
| Blasting volume | | Cracks |
| Charge amount | | 18 kg |
| Blasting efficiency | | 97% |
| Blasting vibration | | 100% |
| Working hours | Drilling | 222 minutes |
| | Charge/Blasting | 300 minutes |
| Blasting expenses (won/m$^3$) | | |
| Personnel expenses | | 2,596 won/m$^3$ |
| Material cost | | 1,048 won/m$^3$ |
| Equipment cost | | 1,507 won/m$^3$ |
| Total | | 5,151 won/m$^3$ |

Embodiment 9

FIG. 19*a* is a plane view which indicates that the blasting mechanism, of the present invention is applied in the blasting of a bench of rock where the last portion of a drilling pattern is remarkably short, and FIG. 19*b* is a cross-sectional view taken along the line A–A' in FIG. 19*a*.

Drilling, charge and blasting are carried out in the same manner as described in Embodiment 1, except that a second group of first-order blasting holes 13*c*, 14*b* and 13*d*, and a third group of first-order blasting holes 13*e*, 14*c* and 13*f*, are additionally drilled as shown in FIGS. 19*a* and 19*b*, and blasting is carried out according to a blasting sequence expressed by each numeral after the symbol "#". In FIGS. 19*a* and 19*b*, the reference numeral 15*a* denotes a first enlarged hole, the reference numeral 15*b* denotes a second enlarged hole, and the reference numerals 13*a*, 14*a* and 13*b* denote a first group of first-order blasting holes.

According to this embodiment, it is possible to reduce the charge amount per delay in the first-order blasting process of two free surfaces, and to conduct the blasting of four free surfaces in the second-order blasting process. Accordingly, it is possible to conduct blasting of the bench of rock so as to coincide with field conditions, while increasing blasting efficiency and reducing blasting nuisances.

Embodiment 10

FIG. 20*a* is a plane view which indicates that the blasting mechanism of the present invention is applied in the blasting of a bench of rock where the last portion of a drilling pattern is remarkably short, and FIG. 20*b* is a cross-sectional view taken along the line A–A' in FIG. 20*a*.

Drilling, charge and blasting are carried out in the same manner as described in Embodiment 1, except that two of second-order blasting holes 15*a* and 15*b* are successively drilled into the left portion of an upper free surface of a bench, an interval between blasting holes is reduced by 30% to 0% as compared to Embodiment 1, and blasting is carried out according to a blasting sequence expressed by each numeral after the symbol "#".

According to this embodiment, it is possible to reduce the charge amount per delay in the first-order blasting process of two free surfaces, and to conduct blasting of four free surfaces in the second-order blasting process. Accordingly, it is possible to conduct blasting of a bench of rock so as to coincide with field conditions, while increasing blasting efficiency and reducing blasting nuisances.

Embodiment 11

FIG. 21*a* is a plane view which indicates that the blasting mechanism of the present invention is applied in the blasting of a bench of rock where the last portion of a drilling pattern is remarkably short, and FIG. 21*b* is a cross-sectional view taken along the line A–A' in FIG. 21*a*.

Drilling, charge and blasting are carried out in the same manner as described in Embodiment 1, except that the delay blasting hole is omitted from any of the respective groups of first-order blasting holes such that only two presplitting holes 13*c* and 13*d* are drilled.

According to this embodiment, it is possible to reduce the charge amount per delay in the first-order blasting process of two free surfaces, and to conduct blasting of four free surfaces in the second-order blasting process. Accordingly, it is possible to conduct blasting of a bench of rock so as to coincide with field conditions, while increasing blasting efficiency and reducing blasting nuisances.

Embodiment 12

FIG. 22*a* is a plane view which indicates that the blasting mechanism of the present invention is applied for regulation of a surface of blasted rock, FIG. 22*b* is a cross-sectional view taken along the line A–A' in FIG. 22*a*, and FIG. 22*c* is a cross-sectional view taken along the line B–B' in FIG. 22*a*.

Drilling, charge and blasting are carried out in the same manner as described in Embodiment 1, except that sub-holes 8*a*, 8*b*, 8*c* and 8*d* are additionally drilled into a slant free surface in a direction toward the bottom of blasting holes, in such a manner that they are disposed on both sides of each of the enlarged holes 15*a* and 15*b*. In order to regulate the surface of the blasted rock, the sub-holes 8*a*, 8*b*, 8*c* and 8*d* are horizontally drilled at an angle of 0 to 20 degrees between a bottom portion of the presplitting holes and a bottom portion of the enlarged holes. A drilling depth of the sub-holes 8*a*, 8*b*, 8*c* and 8*d* is equal to a burden, and a charge amount for the sub-holes is essentially equal to that for the enlarged holes. In addition, the sub-holes 8*a*, 8*b*, 8*c* and 8*d* are blasted following blasting of the enlarged holes.

According to this embodiment, it is possible to reduce the charge amount per delay in the first-order blasting process of two free surfaces, and to conduct blasting of four free surfaces in the second-order blasting process. Accordingly, it is possible to conduct blasting of the bench of rock so as to regulate the surface of blasted rock, while increasing blasting efficiency and reducing blasting nuisances.

Embodiment 13

FIG. 23*a* is a plane view showing that the blasting mechanism of the present invention is applied in the blasting for the excavation of rock, and FIG. 23*b* is a cross-sectional view taken along the line A–A' in FIG. 23*a*.

Blasting for the excavation of rock is a blasting method, which is carried out on rock with one free surface (or upper free surface) so as to form a bench of rock with two free surfaces. As shown in FIGS. 23*a* and 23*b*, a first row of blasting holes 50 with the drilling pattern of Embodiment 1 is drilled downward at a slant into the upper free surface of rock. Here, the second row of blasting holes is drilled at an angle of 30 to 60 degrees with respect to the upper free surface of rock. Thereafter, a second row of blasting holes 60 with the drilling pattern of Embodiment 1 is drilled downward at a slant in the same drilling direction as that of the first row of blasting holes 50, apart from the first row of blasting holes 50 at a distance of 0.5 to 1.5 m. In this case, the second row of blasting holes 60 is drilled at an angle of 50 to 80 degrees with respect to the upper free surface of rock. Next, a third row of blasting holes 70 is drilled downward in front of the first row of blasting holes in an opposite direction, apart from the first row of blasting holes 50 at a distance of 1 to 2 m. In this case, the third row of blasting holes is drilled at an angle of 40 to 70 degrees with respect to the upper free surface of rock. After this, the respective rows of blasting holes are charged with explosives and blasted, according to the same manner as described in Embodiment 1. The blasting process is carried out in a sequence of the first row 50, the second row 60 and the third row 70.

Table 11 below indicates conditions and results of test blasting carried out according to this embodiment.

TABLE 11

| Conditions and results of operation | | |
|---|---|---|
| Equipment | | Leg drill |
| Drilling diameter | | 38 mm |
| Drilling length | | 1.2 m |
| Number of holes | | 21 |
| Interval between holes | | 0.5 m and 0.8 m |
| Blasting volume | | 3,333.5 $m^3$ |
| Blasting efficiency | | 97% |
| Specific charge amount | | 0.283 $kg/m^3$ |
| Specific drilling length | | 2.487 $m/m^3$ |
| Blasting vibration | | 45% |
| Working hours | Drilling | 157.9 minutes |
| | Charge/Blasting | 397.6 minutes |
| Blasting expenses | | |
| Personnel expenses | | 1,762 $won/m^3$ |
| Material cost | | 1,345 $won/m^3$ |
| Equipment cost | | 2,098 $won/m^3$ |
| Total | | 5,205 $won/m^3$ |

COMPARATIVE EXAMPLE 6

This example is given for comparison of the results of Embodiment 13 with results obtained by a blasting method for the excavation of rock according to the prior art.

FIG. 24*a* is a plane view showing a blasting method for the excavation of rock according to the prior art, and FIG. 24*b* is a cross-sectional view taken along the line A–A' in FIG. 24*a*. As shown in FIGS. 24*a* and 24*b*, a first row of blasting holes 50*a* is drilled at a slant into an upper free surface of rock at regular intervals. Also, a second row of blasting holes 60*a* is drilled at a slant into the upper free surface of rock at regular intervals. A third row of blasting holes 70*a* is drilled at a slant into the upper free surface of rock in a direction opposite to the drilling direction of the first and second rows of blasting holes. Then, the blasting holes are charged with explosives and blasted. The blasting process is carried out in a sequence of the first row 50*a*, the second row 60*a* and the third row 70*a*. In the respective rows of blasting holes, one blasting hole positioned at a central portion of the upper free surface of rock is first blasted, after which blasting holes on both sides thereof are successively blasted in a sequence of the blasting holes close to the central blasting hole.

Table 12 below indicates conditions and results of test blasting carried out according to this example.

TABLE 12

| Conditions and results of operation | | |
|---|---|---|
| Equipment | | Leg drill |
| Drilling diameter | | 38 mm |
| Drilling length | | 1.2 m |

TABLE 12-continued

| Conditions and results of operation | | |
|---|---|---|
| Number of holes | | 21 |
| Interval between holes | | 0.6 m |
| Blasting volume | | 3,264.5 $m^3$ |
| Blasting efficiency | | 95% |
| Specific charge amount | | 0.48 $kg/m^3$ |
| Specific drilling length | | 2.573 $m/m^3$ |
| Blasting vibration | | 100% |
| Working hours | Drilling | 177.4 minutes |
| | Charge/Blasting | 418.5 minutes |
| Blasting expenses | | |
| Personnel expenses | | 1,925 $won/m^3$ |
| Material cost | | 1,504 $won/m^3$ |
| Equipment cost | | 2,547 $won/m^3$ |
| Total | | 5,976 $won/m^3$ |

As apparent from the foregoing, according to the method of the present invention, the first-order blasting process of the bench of rock with two free surfaces is carried out with the minimized charge amount per delay so as to form four free surfaces in a castle shape, and the blasting process of the four free surfaces is then carried out. As a result, the present invention provides the blasting method of the bench of rock, by which blasting efficiency can be increased and also blasting nuisances, such as blasting vibration and noise and the like, can be significantly reduced. Moreover, by applying the blasting mechanism of the bench with two free surfaces according to the present invention, a size of fractured rock can be controlled, a surface of blasted rock floor can be made even, and blasting processes can be carried out in such a manner that they coincide with field conditions. In addition, the blasting mechanism of the present invention can be applied in blasting for the excavation of rock, and also in presplitting blasting of rock for formation of a slope.

Although a preferred embodiment of the present invention has been described for illustrative purposes, those skilled in the art will appreciate that various modifications, additions and substitutions are possible, without departing from the scope and spirit of the invention as disclosed in the accompanying claims.

The disclosure in Korean patent application No. 200114411 filed Mar. 20, 2001 is hereby incorporated by reference.

What is claimed is:

1. A blasting method of a bench of rock with two free surfaces consisting of an upper free surface and a slant free surface extended slantly from the upper free surface, which comprises the steps of:

successively drilling a first group of first-order blasting holes consisting of two presplitting holes and one delay blasting hole positioned between the presplitting holes, a second-order blasting hole, and a second group of first-order blasting holes consisting of two presplitting holes and one delay blasting hole positioned between the presplitting holes, on the upper free surface of the bench of rock in a straight line, apart from the slant free surface at a desired distance, in which the first-order blasting holes of the respective groups are spaced apart from each other at a substantially equal interval, and the second-order blasting hole is spaced apart from the prespliting holes adjacent to the second-order blasting hole at a distance longer than the interval between the first-order blasting holes;

charging the first- and second-order blasting holes with explosives, in which the delay blasting holes is charged in an indirect priming manner;

blasting the first and second groups of first-order blasting holes, in such a manner that the presplitting holes are first blasted and then the delay blasting holes are blasted, so as to form four free surfaces around the second-order blasting hole; and blasting the second-order blasting holes where the four free surfaces were formed.

2. The blasting method according to claim 1 which further comprises repeating the drilling, charging and blasting steps on portions that are extended from the blasting holes in a width-wise direction of the bench of rock in a straight line.

3. The blasting method according to claim 1 which further comprises repeating the drilling, charging and blasting steps on portions which.are extended from the blasting holes in a length-wise direction of the bench of rock by a predetermined distance.

4. A blasting method of a bench of rock with two free surfaces consisting of an upper free surface and a slant free surface extended slantly from the upper free surface, which comprises the steps of:

successively drilling a first group of first-order blasting holes consisting of two presplitting holes, a second-order blasting hole, and a second group of first-order blasting holes consisting of two presplitting holes and one delay blasting hole positioned between the presplitting holes, on the upper free surface of the bench of rock in a straight line, apart from the slant free surface at a desired distance, in which the first-order blasting holes of the respective groups are spaced apart from each other at an equal interval, and the second-order blasting hole is spaced apart from the prespliting holes adjacent to the second-order blasting hole at a distance longer than the equal interval between the first-order blasting holes;

charging the first- and second-order blasting holes with explosives, in which the delay blasting holes is charged in an indirect priming manner;

blasting the first and second groups of first-order blasting holes, in such a manner that the presplitting holes are first blasted and then the delay blasting holes are blasted, so as to form four free surfaces around the second-order blasting hole; and blasting the second-order blasting holes where the four free surfaces were formed.

5. A blasting method of a bench of rock with two free surfaces consisting of an upper free surface and a slant free surface extended slantly from the upper free surface, which comprises the steps of:

successively drilling a first group of first-order blasting holes consisting of two presplitting holes and one delay blasting holes positioned between the presplitting holes, a second-order blasting hole, a second group of first-order blasting holes consisting of two presplitting holes and one delay blasting hole positioned between the presplitting holes, and a third group of first-order blasting holes consisting of two presplitting holes and one delay blasting hole positioned between the presplitting holes, on the upper free surface of the bench of rock in a straight line, apart from the slant free surface at a desired distance, in which the first-order blasting holes of the respective groups are spaced apart from each other at an equal interval, and the second-order blasting hole is spaced apart from the prespliting holes adjacent to the second-order blasting hole at a distance longer than the equal interval between the first-order blasting holes;

charging the first- and second-order blasting holes with explosives, in which the delay blasting holes are charged in an indirect priming manner;

blasting the first, second and third groups of first-order blasting holes, in such a manner that the presplitting holes are first blasted and then the delay blasting holes are blasted, so as to form four free surfaces around the second-order blasting hole; and blasting the second-order blasting holes where the four free surfaces were formed.

6. A blasting method of a bench of rock with two free surfaces consisting of an upper free surface and a slant free surface extended slantly from the upper free surface, which comprises the steps of:

successively drilling a first group of first-order blasting holes consisting of two presplitting holes and one delay blasting hole positioned between the presplitting holes, a first enlarged hole, a second group of first-order blasting holes consisting of two presplitting holes and one delay blasting hole positioned between the presplitting holes, a second enlarged hole, and a third enlarged hole adjacent to a side free surface of the bench of rock, on the upper free surface of the bench of rock in a straight line, apart from the slant free surface at a desired distance, in which the first-order blasting holes of the respective groups are spaced apart from each other at an equal interval, and the first enlarged hole is spaced apart from the prespliting holes adjacent to the first enlarged hole at a distance longer than the equal interval between the first-order blasting holes;

charging the first- and second-order blasting holes with explosives, in which the delay blasting holes are charged in an indirect priming manner;

blasting the first and second groups of first-order blasting holes, in such a manner that the presplitting holes are first blasted and then the delay blasting holes are blasted, so as to form four free surfaces around each of the enlarged holes; and blasting the enlarged holes where the four free surfaces were formed.

7. The blasting method according to claim 6 in which each of the holes are charged in a deck charge manner at two sections, an upper section and a lower section, divided in a drilling length-wise direction, and the upper section is blasted before the lower section is blasted.

8. The blasting method according to claim 7 in which the interval between the first-order blasting holes of the respective groups is 0.6 to 0.8 times as large as a burden, and the interval between the second-order blasting hole and the presplitting holes adjacent to the second-order blasting hole is 1.5 times to 2 times as large as the burden.

9. The blasting method according to claim 7 in which the interval between the first-order blasting holes is 0.4 to 0.6 times as large as a burden, and the interval between the second-order blasting hole and the presplitting holes adjacent to the second-order blasting hole is 1.0 times to 1.5 times as large as the burden.

10. The blasting method according to claim 7 in which the interval between the first-order blasting holes of the respective groups is 0.5 to 0.8 times as large as a burden, and the interval between the second-order blasting hole and the presplitting holes adjacent to the second-order blasting hole is 2.0 times to 4.0 times as large as the burden.

11. The blasting method according to claim 7 in which the presplitting holes and the delay blasting holes are charged at a specific charge amount of about 0.1 to 0.25 0.1 kg/m$^3$, and the second-order blasting hole is charged at a specific charge amount of about 0.2 to 0.35 kg/m$^3$.

12. The blasting method according to claim 7 in which the presplitting holes and the delay blasting holes are charged in a middle priming manner or an indirect priming manner.

13. A blasting method of a bench of rock with two free surfaces consisting of an upper free surface and a slant free surface extended slantly from the upper free surface, which comprises the steps of:

successively drilling a first group of first-order blasting holes consisting of two presplitting holes and one delay blasting hole positioned between the presplitting holes, a second-order blasting hole, a second group of first-order blasting holes consisting of two presplitting holes and one delay blasting hole positioned between the presplitting holes, on the upper free surface of the bench of rock in a straight line, apart from the slant free surface at a desired distance, in which the first-order blasting holes of the respective groups are spaced apart from each other at an equal interval, and the first enlarged hole is spaced apart from the prespliting holes adjacent to the second-order blasting hole at a distance longer than the equal interval between the first-order blasting holes;

horizontally drilling a first sub-hole and a second sub-hole on a lower portion of the slant free surface at an angle of 0 to 20 degrees, in such a manner that the sub-holes are disposed on both sides of the second-order blasting hole;

charging the blasting holes and the sub-holes with explosives, in which the delay blasting holes are charged in an indirect priming manner;

blasting the first and second groups of first-order blasting holes, in such a manner that the presplitting holes are first blasted and then the delay blasting holes are blasted, so as to form four free surfaces around the second-order blasting hole;

blasting the second-order blasting hole in a state where the four free surfaces were formed; and blasting the first and second sub-holes so as to make even a surface of the blasted rock.

14. The blasting method according to claim 13 in which the sub-holes are charged at the essentially same charge amount as that of the second-order blasting hole, and drilled so as to have essentially the same drilling depth as a burden.

15. An excavating method of rock for forming a bench of rock with two free surfaces by blasting rock with one free surface, which comprises the steps of:

drilling on the one free surface of rock, three rows of blasting holes consisting of a first row of blasting holes, a second rows of blasting holes arranged in the rear of the first row of blasting holes apart from the first row of blasting holes at a distance of 0.5 to 1.5 meters, and a third row of blasting holes arranged in front of the first row of blasting holes apart from the first row of blasting holes at a distance of 1 to 2 meters, in which the first row of blasting holes have a slope of 30 to 60 degrees with respect to the one free surface of rock, the second row of blasting holes are drilled in the same drilling direction as that of the first row of blasting holes and have a slope of 50 to 80 degrees with respect to the one free surface of rock, and the third row of blasting holes are drilled in a direction opposite to that of the first row of blasting holes and have a slope of 40 to 70 degrees with respect to the one free surface of rock, and in which the blasting holes of the respective rows are successively arranged in a straight line and consist of a first group of first-order blasting holes consisting of two presplitting holes and one delay blasting hole positioned between the presplitting holes, a second-order blasting hole, a second group of first-order blasting holes consisting of two presplitting holes and one delay blasting hole positioned between the presplitting holes, in which the first-order blasting holes of the respective groups are spaced apart from each other at an equal interval, and the second-order blasting hole is spaced apart from the prespliting holes adjacent to the second-order blasting hole, at a distance longer than the equal interval between the first-order blasting holes;

charging the blasting holes with explosives, in which the delay blasting holes are charged in an indirect priming manner;

successively blasting the first row of blasting holes, the second row of blasting holes and the third row of blasting holes, in which the blasting holes of the respective rows are blasted, in such a manner that the presplitting holes are first blasted and then the delay blasting holes are blasted, so as to form four free surfaces around the second-order blasting hole, after which the second-order blasting hole is blasted.

16. A blasting method for forming a slope on rock by blasting a bench of rock with two free surfaces consisting of an upper free surface and a slant free surface extended slantly from the upper free surface, which comprises the steps of:

drilling on the upper free surface of the bench, blasting holes in multiple rows spaced apart from each other in a length-wise direction of the bench, in which the blasting holes of the respective rows are successively arranged in a straight line and consist of a first group of first-order blasting holes consisting of two presplitting holes and one delay blasting hole positioned between the presplitting holes, a second-order blasting hole, a second group of first-order blasting holes consisting of two presplitting holes and one delay blasting hole positioned between the presplitting holes, in which the first-order blasting holes of the respective groups are spaced.apart from each other at an equal interval, and the second-order blasting hole is spaced apart from the prespliting holes adjacent to the first enlarged hole at a distance longer than the equal interval between the first-order blasting holes;

charging the blasting holes with explosives, in which the delay blasting holes are charged in an indirect priming manner; and blasting the blasting holes of the row arranged at a portion predetermined for the slope and then blasting the blasting holes in a sequence of the row arranged close to the slant free surface, in which the blasting holes of the respective rows are blasted in such a manner that the presplitting holes are first blasted and then the delay blasting holes are blasted, so as to form four free surfaces around the second-order blasting hole, after which the second-order blasting hole is blasted.

* * * * *